US006938589B2

(12) United States Patent
Park

(10) Patent No.: US 6,938,589 B2
(45) Date of Patent: Sep. 6, 2005

(54) VARIABLE DISPLACEMENT ENGINE

(75) Inventor: Bret J. Park, South Jordan, UT (US)

(73) Assignee: Powervantage Engines, Inc.

( * ) Notice: Subject to any disclaimer, the term of this patent is extended or adjusted under 35 U.S.C. 154(b) by 103 days.

(21) Appl. No.: 10/302,595

(22) Filed: Nov. 25, 2002

(65) Prior Publication Data

US 2004/0089252 A1 May 13, 2004

Related U.S. Application Data

(60) Provisional application No. 60/425,110, filed on Nov. 7, 2002.

(51) Int. Cl.[7] ..... F02B 75/18
(52) U.S. Cl. ..... 123/56.4; 123/48 B
(58) Field of Search ..... 123/48 B, 48 R

(56) References Cited

U.S. PATENT DOCUMENTS 1,536,262 A * 5/1925 Olivier ..... 74/60
1,968,470 A * 7/1934 Szombathy ..... 123/56.4
2,026,705 A * 1/1936 Pratt ..... 123/43 A
2,227,736 A * 1/1941 Olson ..... 123/48 B
3,688,499 A 9/1972 Esperson
3,830,212 A 8/1974 Seino et al.
3,850,258 A 11/1974 Bauer
4,131,094 A 12/1978 Crise
4,166,398 A * 9/1979 Girodin ..... 74/60
4,203,396 A * 5/1980 Berger ..... 123/56.5
4,329,899 A * 5/1982 Hori ..... 83/320
4,433,596 A * 2/1984 Scalzo ..... 74/839
4,454,779 A * 6/1984 Vos ..... 74/60
4,711,139 A 12/1987 Desousa
4,827,721 A 5/1989 Hayashi et al.
4,864,986 A * 9/1989 Bethel et al. ..... 123/193.6
4,936,155 A 6/1990 Gogins
5,027,756 A * 7/1991 Shaffer ..... 123/56.5
5,065,578 A 11/1991 Nakajima et al.
5,136,987 A 8/1992 Schechter et al.
5,165,368 A 11/1992 Schechter
5,189,927 A 3/1993 Egan
5,415,602 A 5/1995 Benesch
5,507,701 A * 4/1996 Benesch ..... 475/169
5,582,556 A 12/1996 Phung
5,595,146 A 1/1997 Bollig et al.
5,782,091 A 7/1998 Nakajima
5,791,302 A 8/1998 Ma
5,797,822 A 8/1998 Green
5,927,236 A 7/1999 Gonzalez
5,974,799 A 11/1999 Nakajima et al.
5,992,357 A * 11/1999 Tasi ..... 123/56.2
6,016,719 A 1/2000 Park
6,099,262 A 8/2000 Iino et al.
6,305,335 B1 * 10/2001 O'Toole ..... 123/56.3
6,334,423 B1 1/2002 Mashimo
6,431,017 B1 8/2002 Robadey
6,606,970 B2 * 8/2003 Patton ..... 123/25 C

* cited by examiner

*Primary Examiner*—Henry C. Yuen
*Assistant Examiner*—Jason Benton

(57) ABSTRACT

An internal combustion engine having at least one piston with an adjustable stroke length. The engine includes a connecting rod attached to the piston and a crankshaft. The crankshaft has a journal portion that extends along a length that is non-perpendicular to a movement axis of the piston. The crankshaft may be moved in a longitudinal direction with respect to the piston to adjust the position of the connecting rod on the journal portion and to thereby adjust the stroke length of the piston.

135 Claims, 37 Drawing Sheets

VARIABLE DISPLACEMENT ENGINE

CROSS-REFERENCE TO RELATED APPLICATIONS

This application claims the benefit of a U.S. Provisional Application No. 60/425,110, filed Nov. 7, 2002, entitled "VARIABLE DISPLACEMENT ENGINE" which is hereby incorporated by reference herein in its entirety, including but not limited to those portions that specifically appear hereinafter, the incorporation by reference being made with the following exception: In the event that any portion of the above-referenced provisional application is inconsistent with this application, this application supercedes said above-referenced provisional application.

STATEMENT REGARDING FEDERALLY SPONSORED RESEARCH OR DEVELOPMENT

Not Applicable.

BACKGROUND OF THE INVENTION

1. The Field of the Invention

The present invention relates generally engines, and more particularly, but not necessarily entirely, to internal combustion engines having pistons with a variable stroke length.

2. Description of Related Art

Internal combustion engines with reciprocating pistons are commonly used for powering automobiles. A break-away side view of a prior art engine, indicated generally at 1, is shown in FIG. 22. As is known in the art of internal combustion engines, pistons 2 are received in cylinders 3 and are caused to reciprocate in a direction parallel with the cylinders 3 along the movement axis 4 upon the combustion of fuel within the cylinders 3. Connecting rods 5 are attached to the pistons 2 and to a crankshaft 6. The movement of the pistons 2 is transferred to the crankshaft 6 through the connecting rods 5. The crankshaft 6 customarily extends in a direction along a rotation axis 7 that is perpendicular to the piston movement axis 4. Moreover, as the pistons 2 move along the movement axis 4, the connecting rods 5 move a fixed radial distance 8 from the axis of rotation 7 of the crankshaft 6.

The pistons 2 have a stroke length correlated with the radial distance 8. The stroke length extends between a top dead center position, or the position at which a piston reaches the top of its travel, to the bottom dead center position, or the extreme bottom of the piston stroke. Internal combustion engines are commonly designed with a fixed stroke length and may be configured to provide maximum operating efficiency at a given throttle position. Accordingly, when the engine is not operating at that given throttle position, the engine will be less efficient, resulting in wastage of fuel or diminished power output, for example.

Moreover, the range of output capabilities is fixed in the prior art engine so that the engine may not be well suited for variable operational needs. For example, engines are commonly built with a specific purpose in mind. Some engines are built to produce economical transportation. These engines are commonly associated with low power capabilities. Other engines may be manufactured to produce high performance and high speeds. These engines are commonly associated with low fuel mileage. Other engines are produced with high towing power in mind. These engines may not be suitable for high speed functions or high fuel economy. Accordingly, the prior art engines have experienced a compromise between such operational features as economy and power.

It is known in the art to vary the stroke length of the piston to modify the operating characteristics of the internal combustion engine. For example, U.S. Pat. No. 5,927,236 (granted Jul. 27, 1999 to Gonzalez) discloses a variable stroke mechanism for internal combustion engines utilizing gear sets to modify the length of the connecting rod. The mechanism is designed to increase the efficiency of the engine by imposing a larger expansion stroke and a shorter intake stroke. However, the gear sets increase the complexity and cost of the engine, and make operation and repair more difficult.

Also, U.S. Pat. No. 5,136,987 (granted Aug. 11, 1992 to Schechter et al.) discloses a variable displacement and compression ratio piston engine. A connecting rod is attached to the piston and a swing plate. The swing plate is pivotally fixed to the engine block at one end and is placed between the connection rod and a crankshaft. A hydraulically controlled adjustment link is pivotally fixed to the engine block at one end and to the connecting rod and the swing plate at the other end. The connecting rod and crankshaft are attached to the swing plate through slots in the swing plate such that the hydraulically controlled adjustment link can vary the distance between the piston and the crankshaft to thereby vary the stroke length. However, the sliding action of the connecting rod and the crankshaft in the slots in the swing plate may cause undue friction and wear in the engine.

The prior art is thus characterized by several disadvantages that are addressed by the present invention. The present invention minimizes, and in some aspects eliminates, the above-mentioned failures, and other problems, by utilizing the methods and structural features described herein.

It would therefore be an advancement in the prior art to provide an engine that allows for adjustment of the operational characteristics of the engine in a simple manner, so that the engine is not required to compromise between power and economy. It would also be an improvement in the prior art to provide such an engine that allows for adjustment of the radial distances between the connecting rod and the axis of rotation of the crankshaft to thereby provide a variable stroke length of the piston. It would be a further advancement in the art to provide such an engine that provides for adjustment of the piston stroke length by allowing the axis of rotation of the crankshaft to extend at a non-perpendicular angle with respect to the movement axis of the piston. It would be an additional advancement over the prior art variable-stroke engine crankshafts, which typically include moving parts, to provide a variable-stroke engine having a solid crankshaft with no moving parts, which would be less prone to failure or to require excessive maintenance.

The features and advantages of the invention will be set forth in the description which follows, and in part will be apparent from the description, or may be learned by the practice of the invention without undue experimentation. The features and advantages of the invention may be realized and obtained by means of the instruments and combinations particularly pointed out in the appended claims.

BRIEF DESCRIPTION OF THE DRAWINGS

The features and advantages of the invention will become apparent from a consideration of the subsequent detailed description presented in connection with the accompanying drawings in which.

DETAILED DESCRIPTION OF THE INVENTION

Figure 1A:
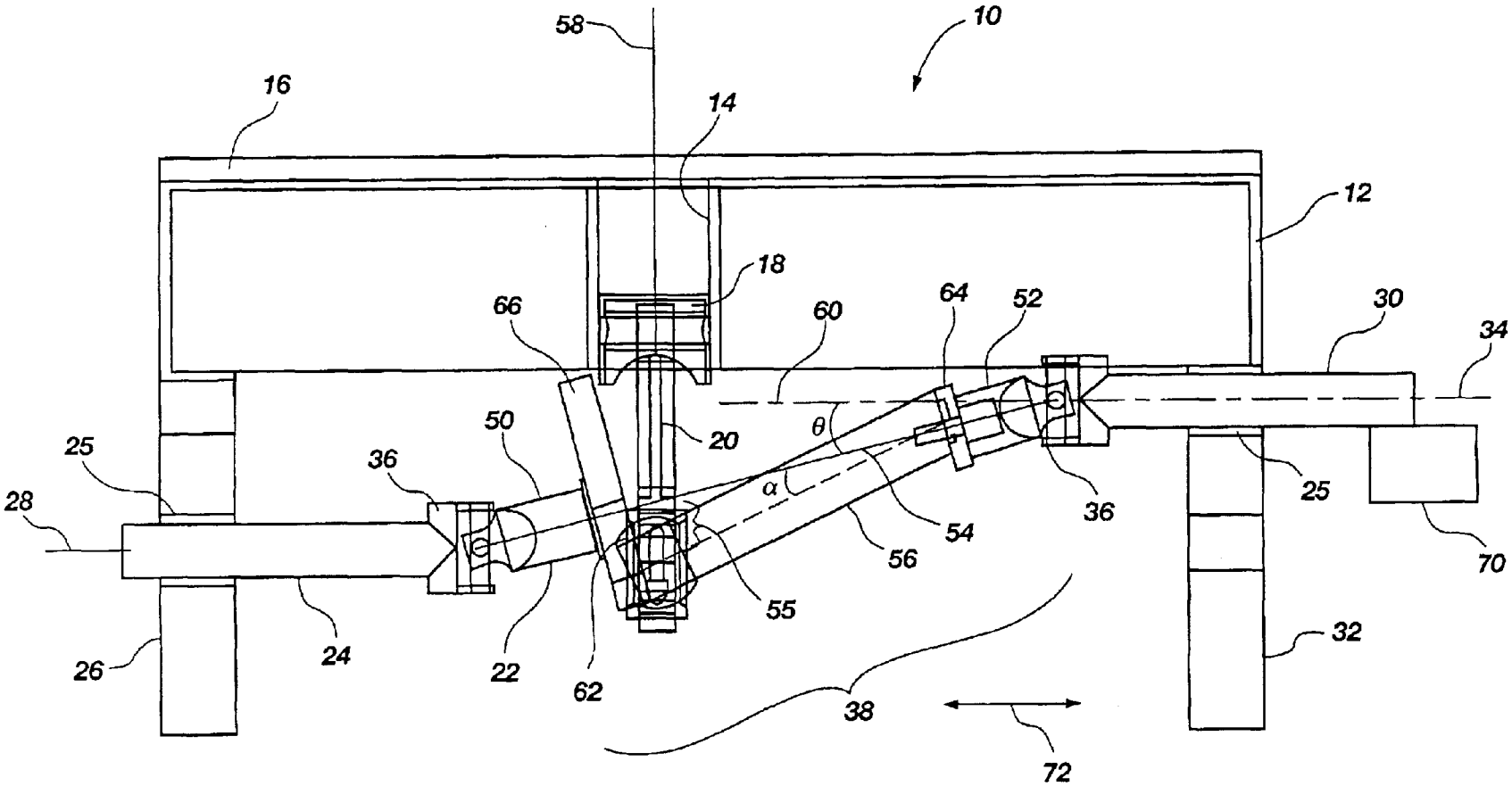
FIG. 1*a* is a break-away side view of an embodiment of an engine made in accordance with the principles of the present invention with the piston in a long stroke, bottom dead center position.

For the purposes of promoting an understanding of the principles in accordance with the invention, reference will now be made to the embodiments illustrated in the drawings and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would normally occur to one skilled in the relevant art and having possession of this disclosure, are to be considered within the scope of the invention claimed.

It must be noted that, as used in this specification and the appended claims, the singular forms "a," "an," and "the" include plural referents unless the context clearly dictates otherwise. Moreover, as used herein, the terms "comprising," "including," "containing," "characterized by," and grammatical equivalents thereof are inclusive or open-ended terms that do not exclude additional, unrecited elements or method steps.

As used herein the term "compression ratio" refers to the ratio of the maximum to the minimum volume within the cylinder, between the piston and cylinder head, in accordance with the customary usage of the term "compression ratio" by those skilled in the art.

Figure 18A:
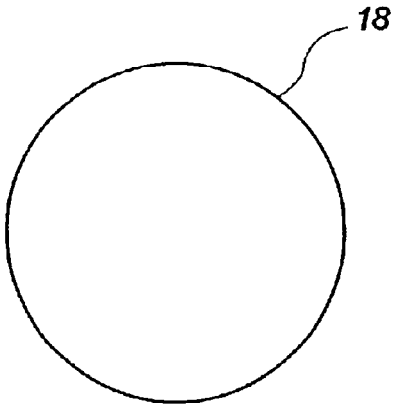
FIG. 18*a* is a top view of a piston.
Figure 18B:
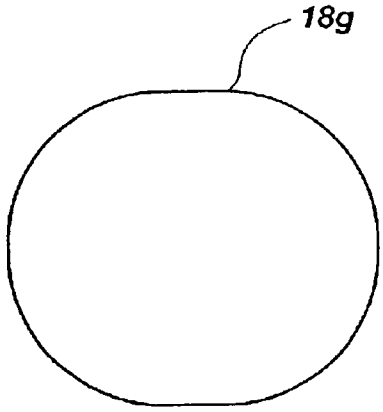
FIG. 18*b* is a top view of an alternative embodiment piston.

Referring now to FIG. 1*a*, a break-away side view of an internal combustion engine is shown, indicated generally at 10. The engine 10 may include an engine block 12 having one or more cylinders 14 formed in any size or configuration known in the art of internal combustion engines. A cylinder head 16 may be secured to the engine block 12 on the top of the cylinder 14. A piston 18 may be slidably received in the cylinder 14. The piston 18 may be of any variety known in the art of internal combustion engines and may have various shapes, such as round or oval cross sectional shapes, for example, as shown in FIGS. 18*a* and 18*b*. Moreover, the pistons may have various different sizes within the scope of the present invention. The piston 18 may be attached to a connecting rod 20 so that reciprocating movement of the piston 18 may be transferred to a crankshaft 22.

Figure 7A:
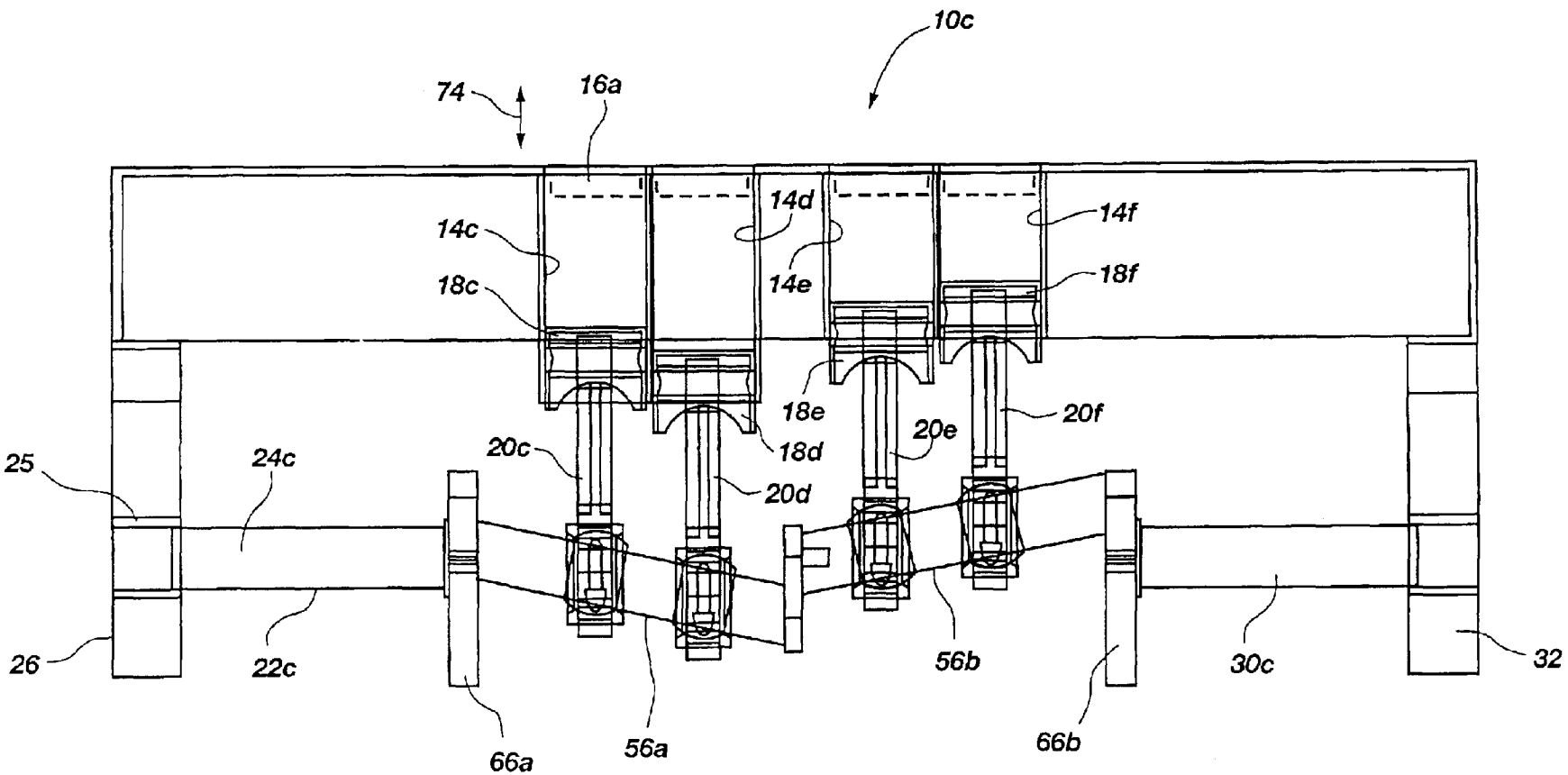
FIG. 7*a* is a break-away side view of an alternative embodiment of the present invention having multiple journal portions and a crankshaft without universal connections.

The crankshaft 22 may have a first end portion 24 that may be received in a first side support 26 on the engine 10, such that the first end portion 24 is permitted to rotate with respect to the first side support 26 about a first axis of rotation 28. The crankshaft 22 may also include a second end portion 30 opposite the first end portion 24. The second end portion 30 may be supported on a second side support 32 in a manner similar to the first end portion 24, and may be configured to be parallel with the first end portion 24. It will be understood that the first end portion 24 may be coaxial with the second end portion, as shown in FIG. 7*a*, or the first end portion 24 may be non-parallel with the second end portion 30 within the scope of the present invention. The second end portion 30 may be rotatable about a second axis of rotation 34. Support bearings 25 may be positioned on the first side support 26 and the second side support 32 to reduce the friction of the rotational contact of the crankshaft 22 with the first side support 26 and the second side support 32. The support bearings 25 may be configured in any manner know to those skilled in the art.

Figure 3:
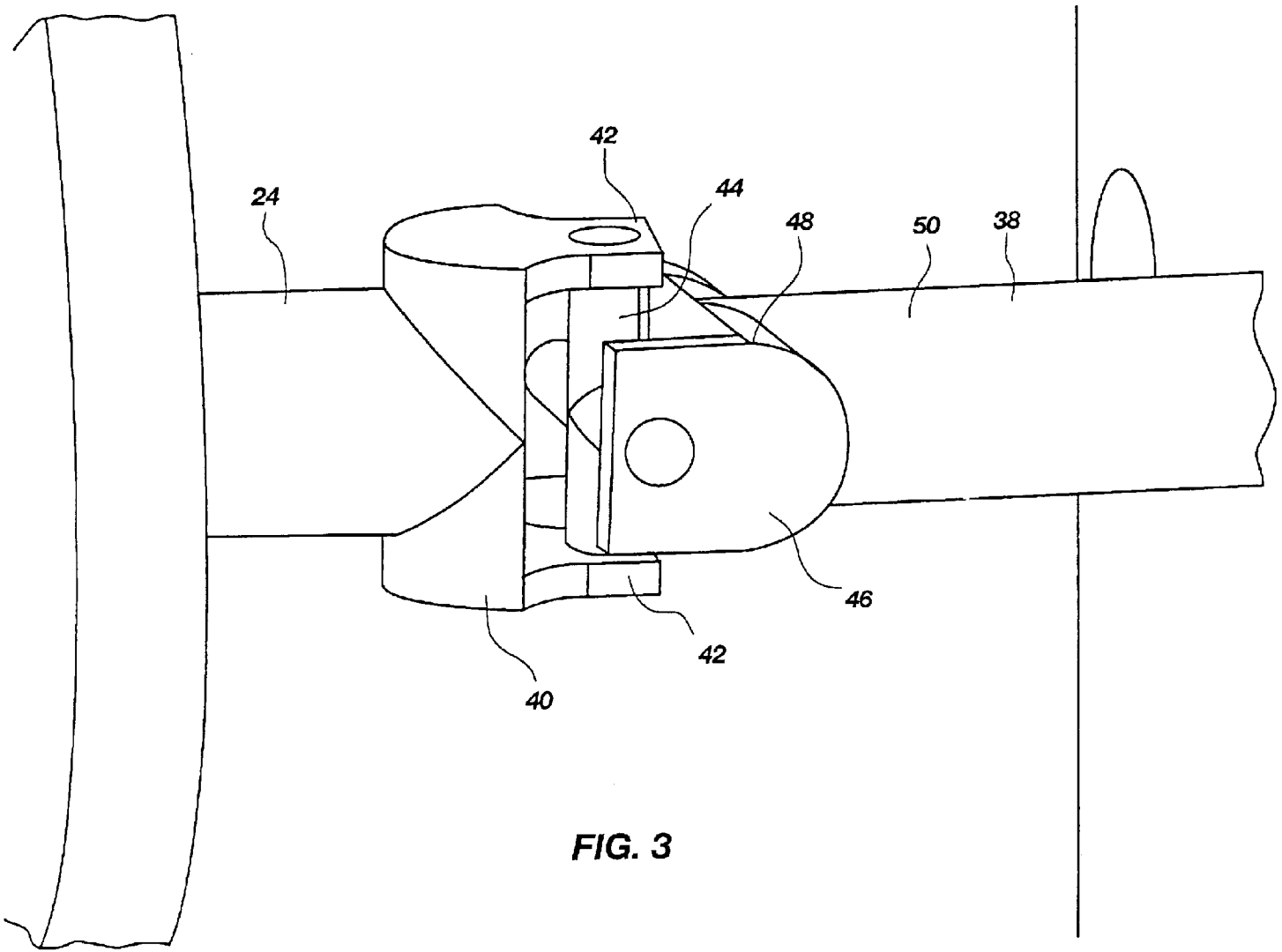
FIG. 3 is a break-away perspective view of an embodiment of a universal connection as shown in FIGS. 1–2.
Figure 4A:
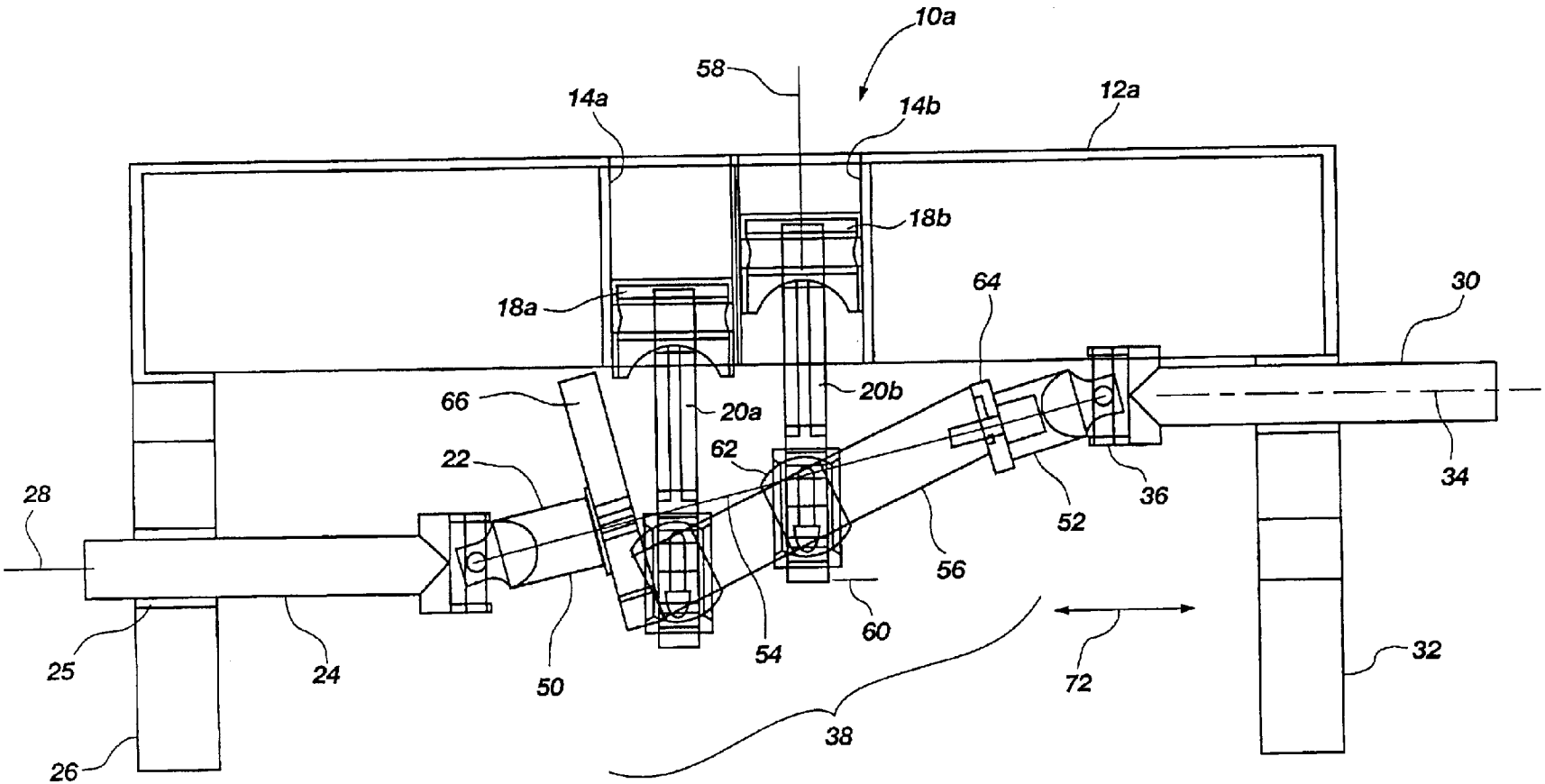
FIG. 4*a* is a break-away side view of an alternative embodiment of the present invention having two pistons in a long stroke bottom dead center position.
Figure 4B:
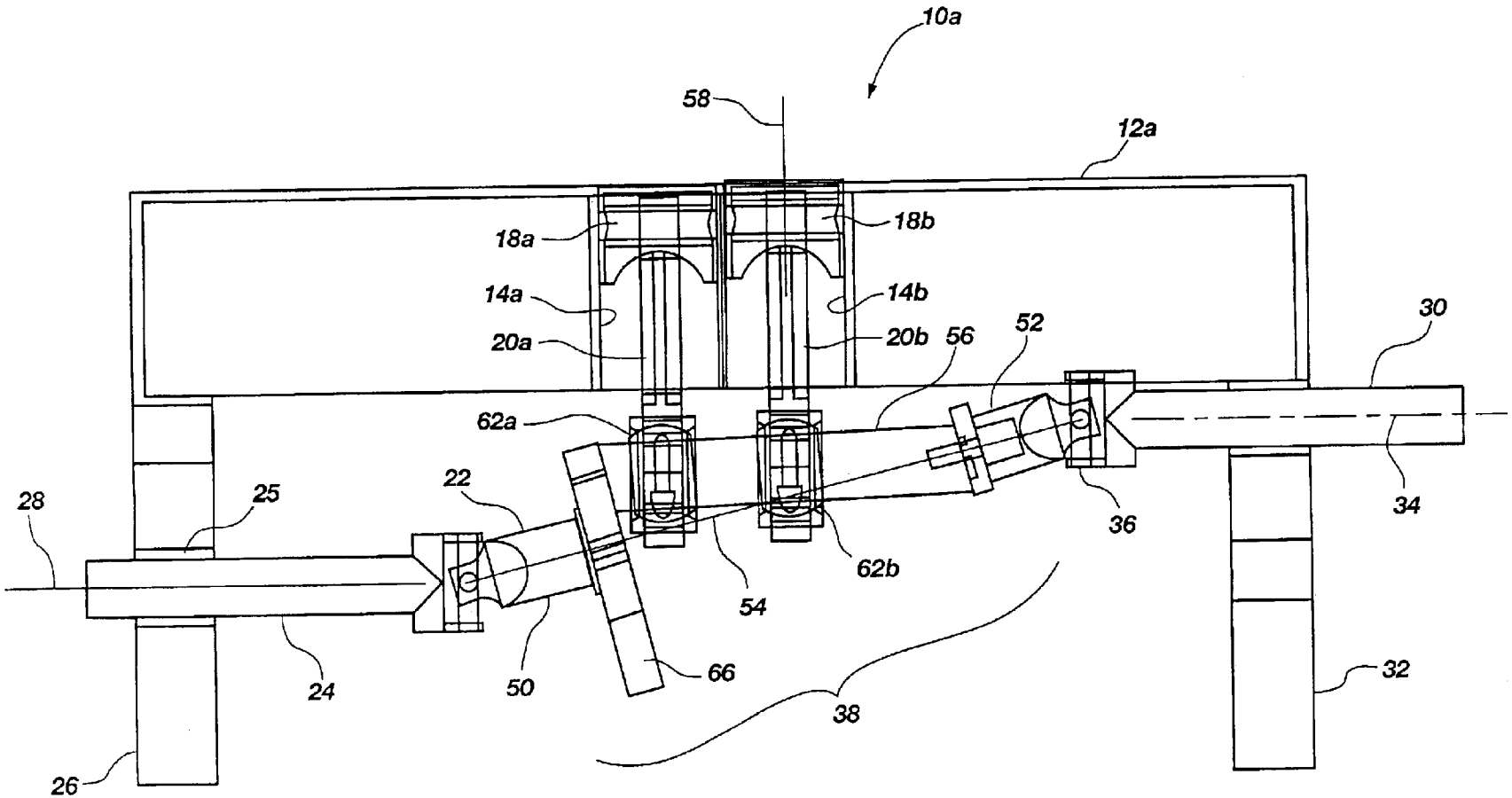
FIG. 4*b* is a break-away side view of the embodiment of FIG. 4*a* with the pistons in a long stroke, top dead center position.
Figure 4C:
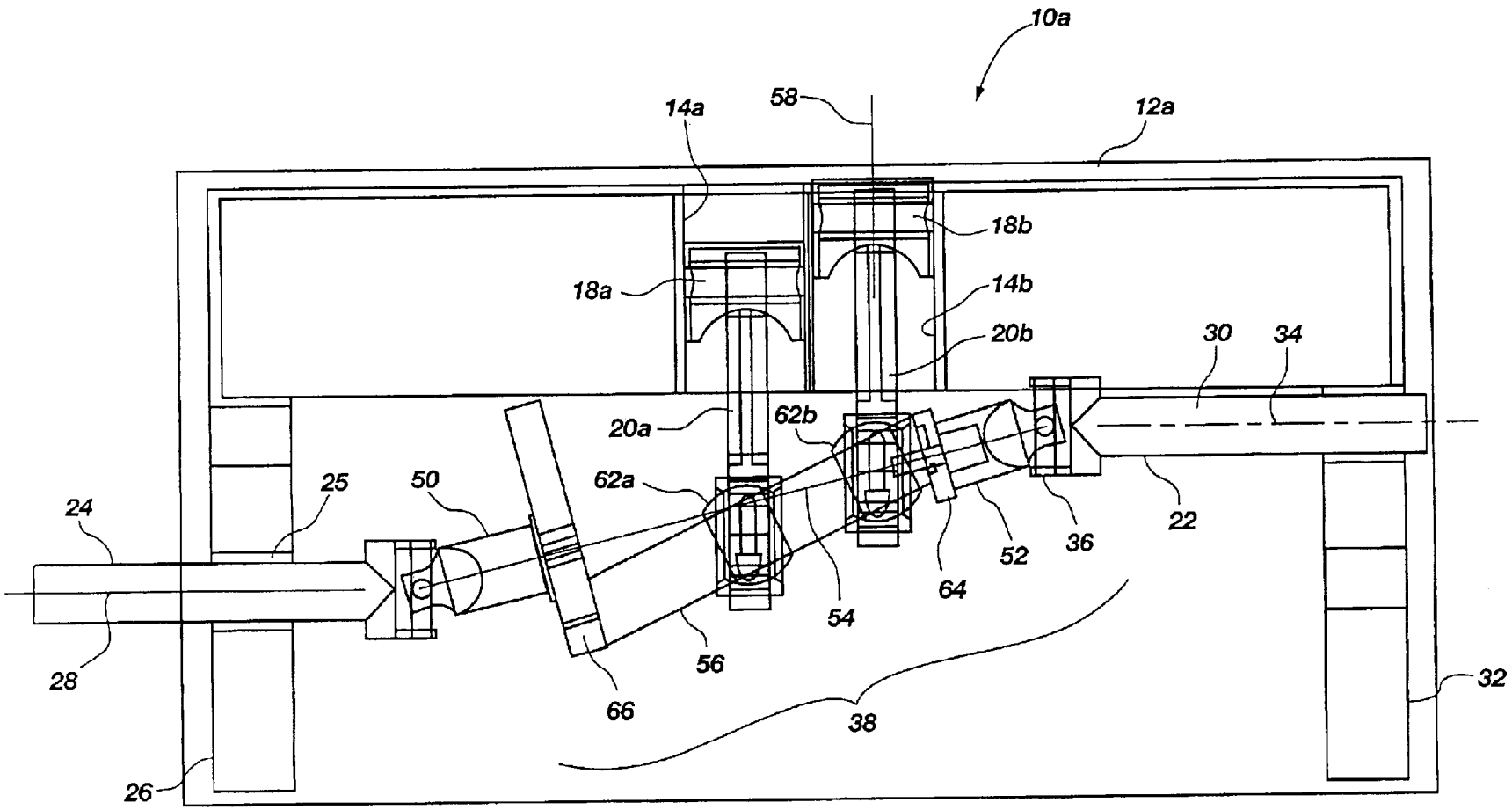
FIG. 4*c* is a break-away side view of the embodiment of FIG. 4*a* with the piston 18*a* in a short stroke, bottom dead center position, and piston 18*b* is at a position of no movement.
Figure 4D:
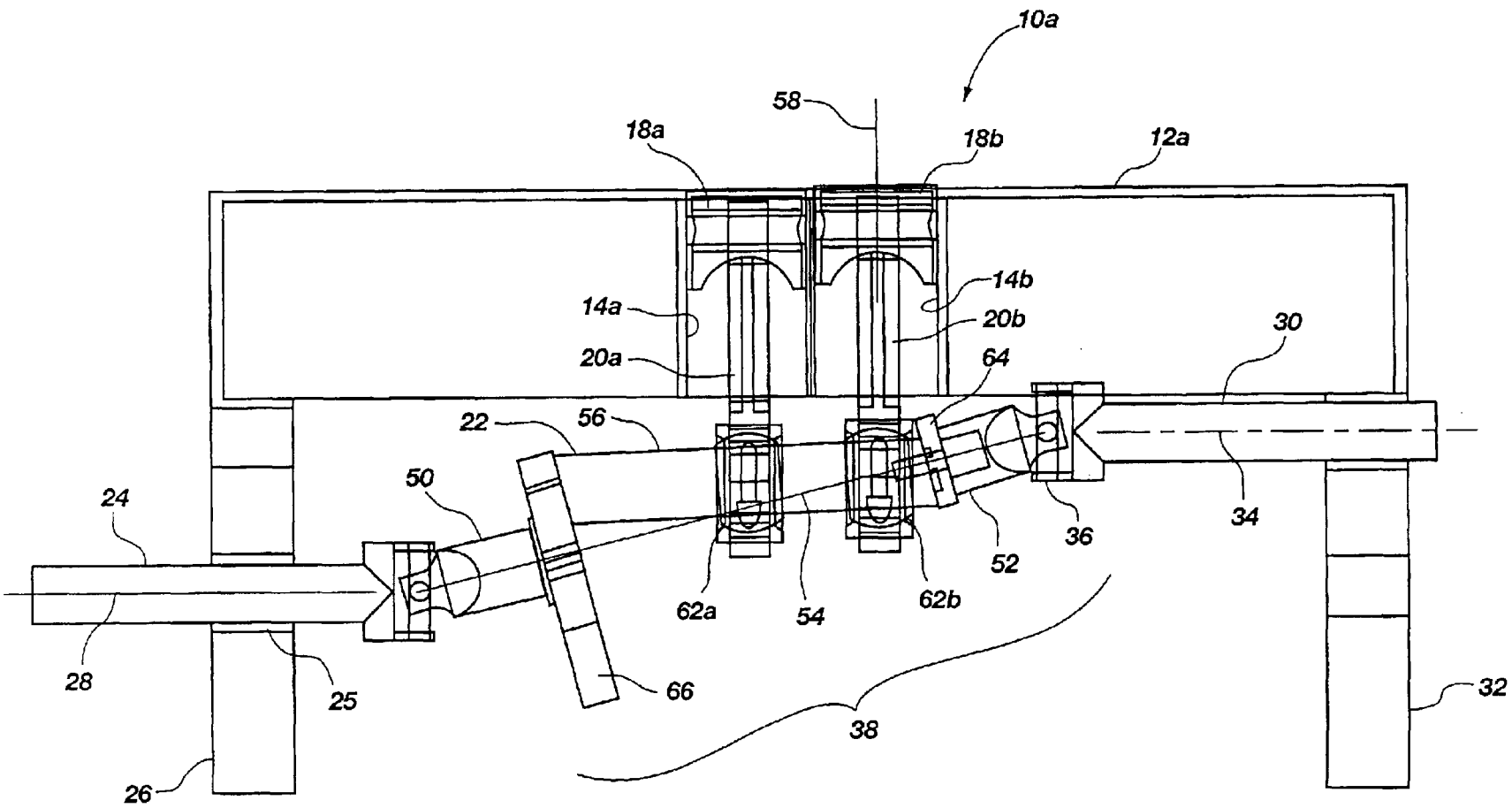
FIG. 4*d* is a break-away side view of the embodiment of FIG. 4*a* with the pistons in a short stroke, top dead center position.

The first end portion 24 and the second end portion 30 may each include a universal connection 36, also sometimes referred to as a universal joint, attached to an angled segment 38 of the crankshaft 22. Stated another way, a universal connection 36 intercouples the angled segment 38 with the first end portion 24, and another universal connection 36 intercouples the angled segment 38 with the second end portion 24. As shown most clearly in FIG. 3, the universal connection 36 may include a first span 40 that may be fixedly attached to the first end portion 24. The first span 40 may include spaced apart walls 42 for supporting a pivot 44, such that the pivot 44 may be allowed to rotate with respect to the first span 40. The pivot 44 may include two rods fixed together forming an intersection. One of the rods may be supported in the spaced apart walls 42 of the first span 40, and the other rod may be supported in corresponding complementary spaced apart walls 46 of a second span 48. The second span 48 may be fixed to a first end 50 of the angled segment 38, or a second end 52 of the angled segment 38. Accordingly, the connection 36 is configured to transfer rotational motion from the first end portion 24, or the second end portion 30, to the angled segment 38 while allowing pivotal movement in different directions about the pivot 44. It will be appreciated that other types of connections that allow transferring rotational movement between articulating members may be used within the scope of the present invention.

The angled segment 38 may include a third axis of rotation 54, also referred to herein as an angled segment axis of rotation, extending between the first end 50 of the angled portion 38 to the second end 52 of the angled portion 38. The angled segment 38 may also include a journal portion 56 between the first end 50 and the second end 52. The journal portion 56 may be configured to form an angle that is non-perpendicular with the movement axis 58 of the piston 18. In the embodiment shown in FIG. 1*a*, the journal portion 56 may be angularly offset from the third axis of rotation 54 as well as the first axis of rotation 28 and the second axis of rotation 34, such that the journal portion 56 may be non-parallel with the first axis of rotation 28, the second axis of rotation 34 and the third axis of rotation 54. However, it will be appreciated that the crankshaft 22 may be configured such that the journal portion 56 may be coaxial with one or more of the first axis of rotation 28, the second axis of rotation 34 or the third axis of rotation 54, and still form an angle that is non perpendicular with the movement axis 58 of the piston 18.

A line that is perpendicular with the movement axis 58 of the piston 18 is depicted as shown at reference numeral 60. The third axis of rotation 54 may extend at an angle θ from the line 60 selected to provide optimal operating characteristics of the engine 10 based on numerous variables such as fuel type, fuel grade, temperature, and pressure. The angle θ between the third axis of rotation 54 and the line 60 may also be selected to provide a desired compression ratio, and to allow the stroke length to be changed without causing the piston 18 to contact the engine head 16. The orientation of the third axis of rotation 54 may be fixed for a particular engine 10, or the crankshaft 22 may be configured such that the angular orientation of the third axis of rotation 54 may be adjustable within the scope of the present invention.

The third axis of rotation 54 may extend at an angle θ from the line 60 at any angle in a range of between approximately 0 degrees and approximately 90 degrees. In one embodiment, the angle θ may be configured within a range of between approximately 5 degrees and approximately 25 degrees. For example, an angle θ of approximately 15 degrees has been demonstrated to be useful for a particular application. However, it will be appreciated that the third axis of rotation 54 may extend at other angles θ with respect to the line 60 within the scope of the present invention to meet the top dead center and bottom dead center variation needs for a particular use. For example, the top dead center and bottom dead center variation requirements for a particular use may make various angles θ suitable, such as angles θ in ranges of between approximately 0–10 degrees, 10–20 degrees, 20–30 degrees, 30–40 degrees, 40–50 degrees, 50–60 degrees, 60–70 degrees, 70–80 degrees, or 80–90 degrees. For example, the third axis of rotation 54 may extend at an angle θ of approximately 5, 15, 25, 35, 45, 55, 65, 75, or 85 degrees or any other angle depending upon the particular top dead center and bottom dead center variation requirements for a given situation.

Figure 1B:
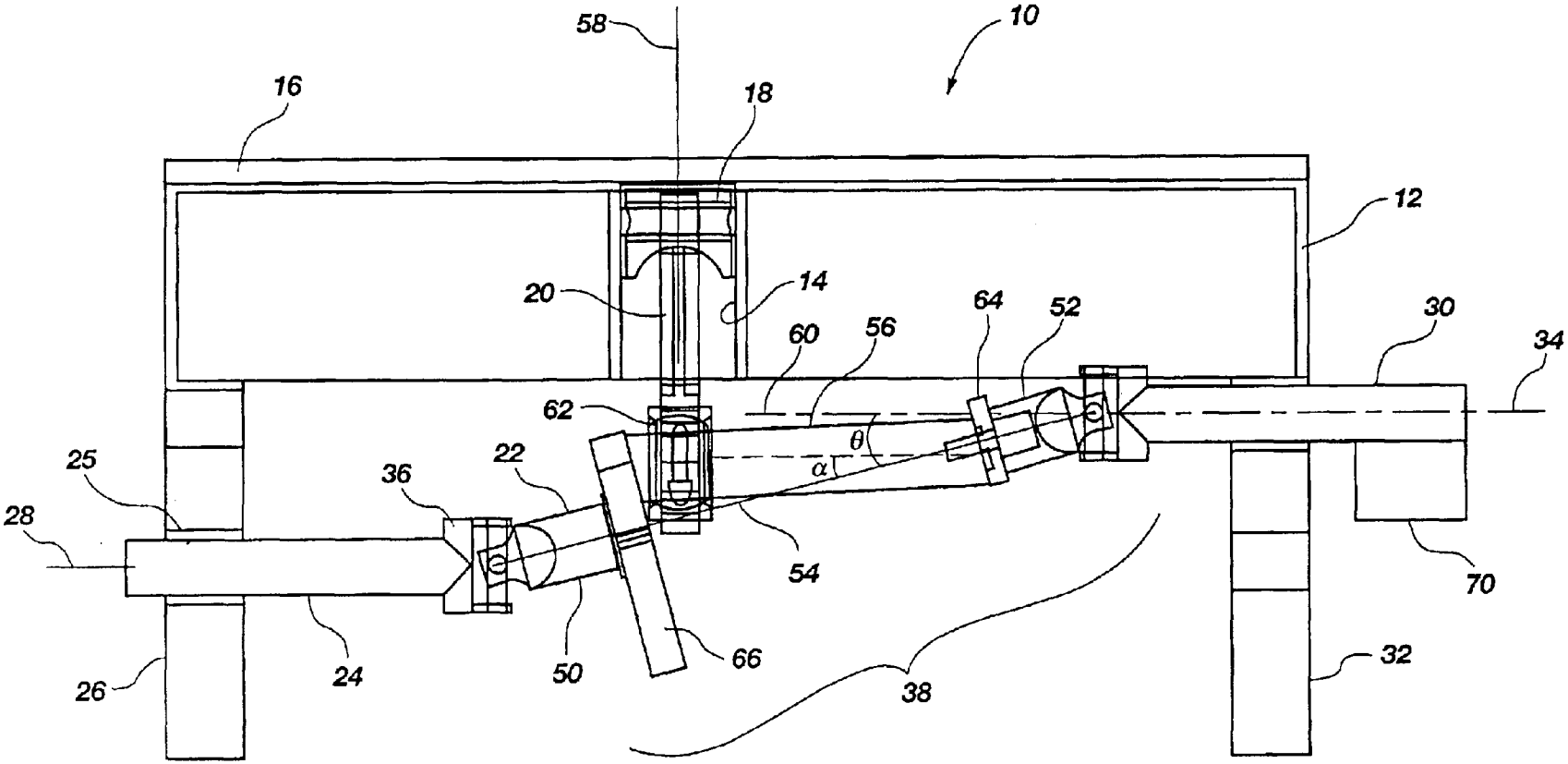
FIG. 1*b* is a break-away side view of the embodiment of FIG. 1*a* with the piston in a long stroke, top dead center position.
Figure 1C:
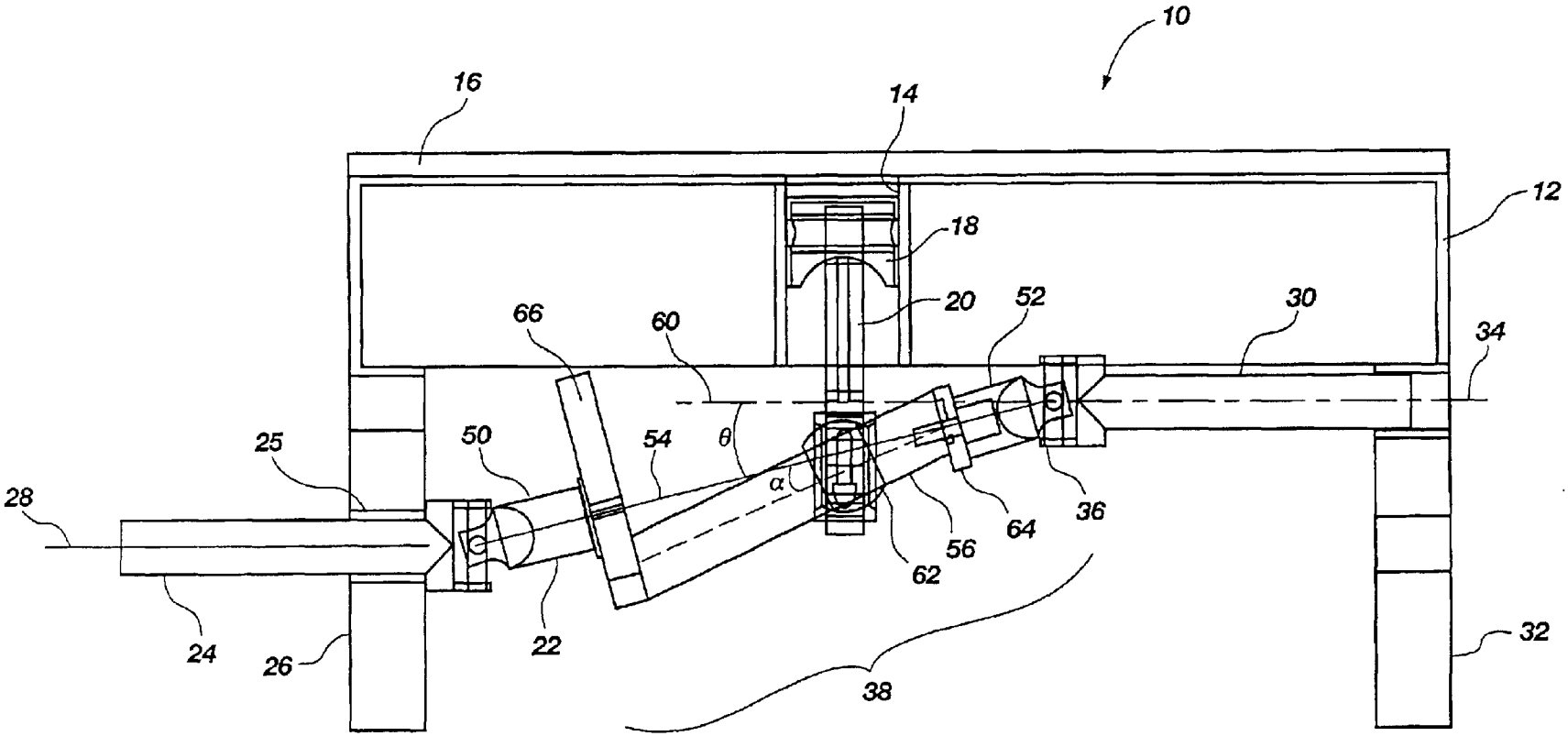
FIG. 1*c* is a break-away side view of the embodiment of FIG. 1*a* with the piston in a short stroke, bottom dead center position.
Figure 1D:
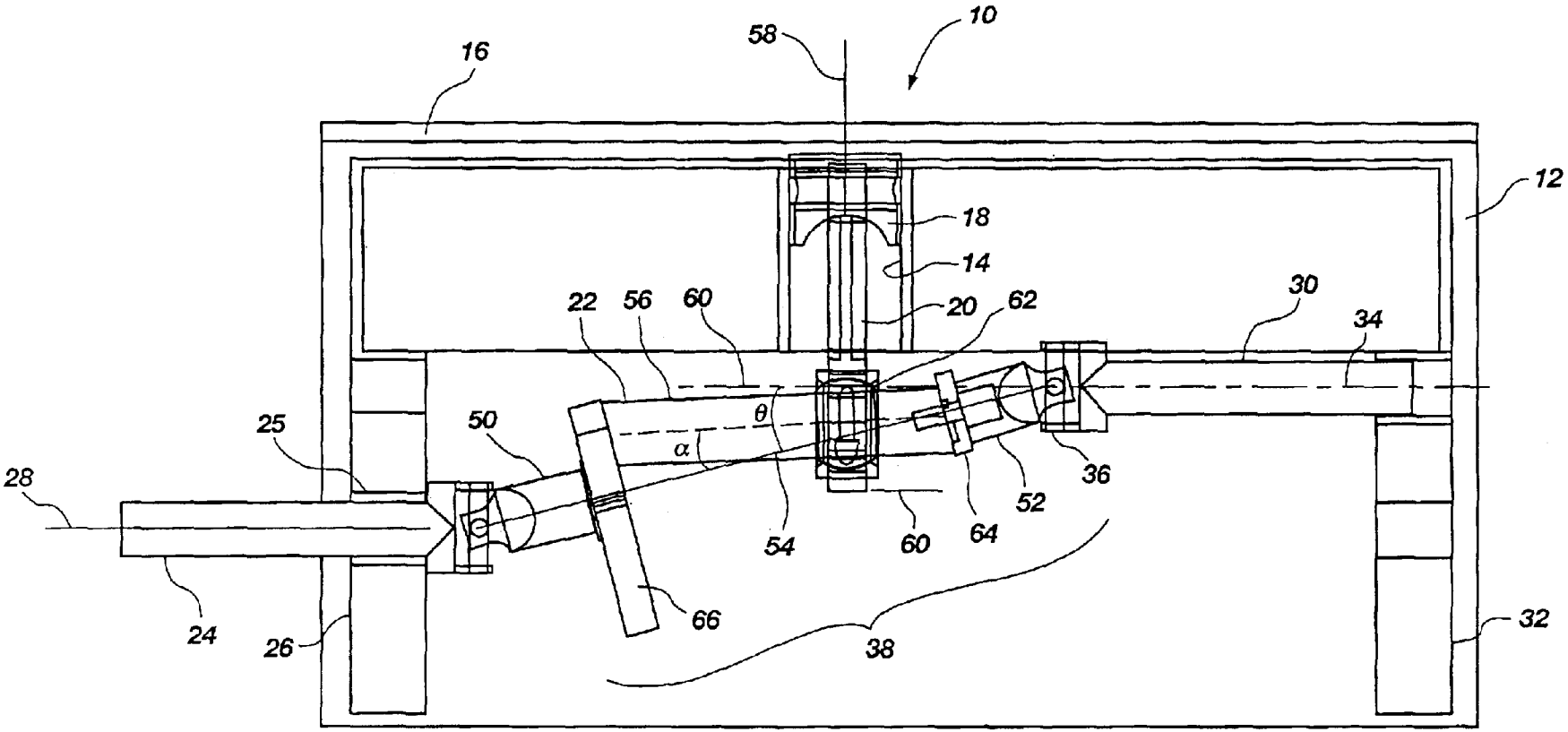
FIG. 1*d* is a break-away side view of the embodiment of FIG. 1*a* with the piston in a short stroke, top dead center position.
Figure 1E:
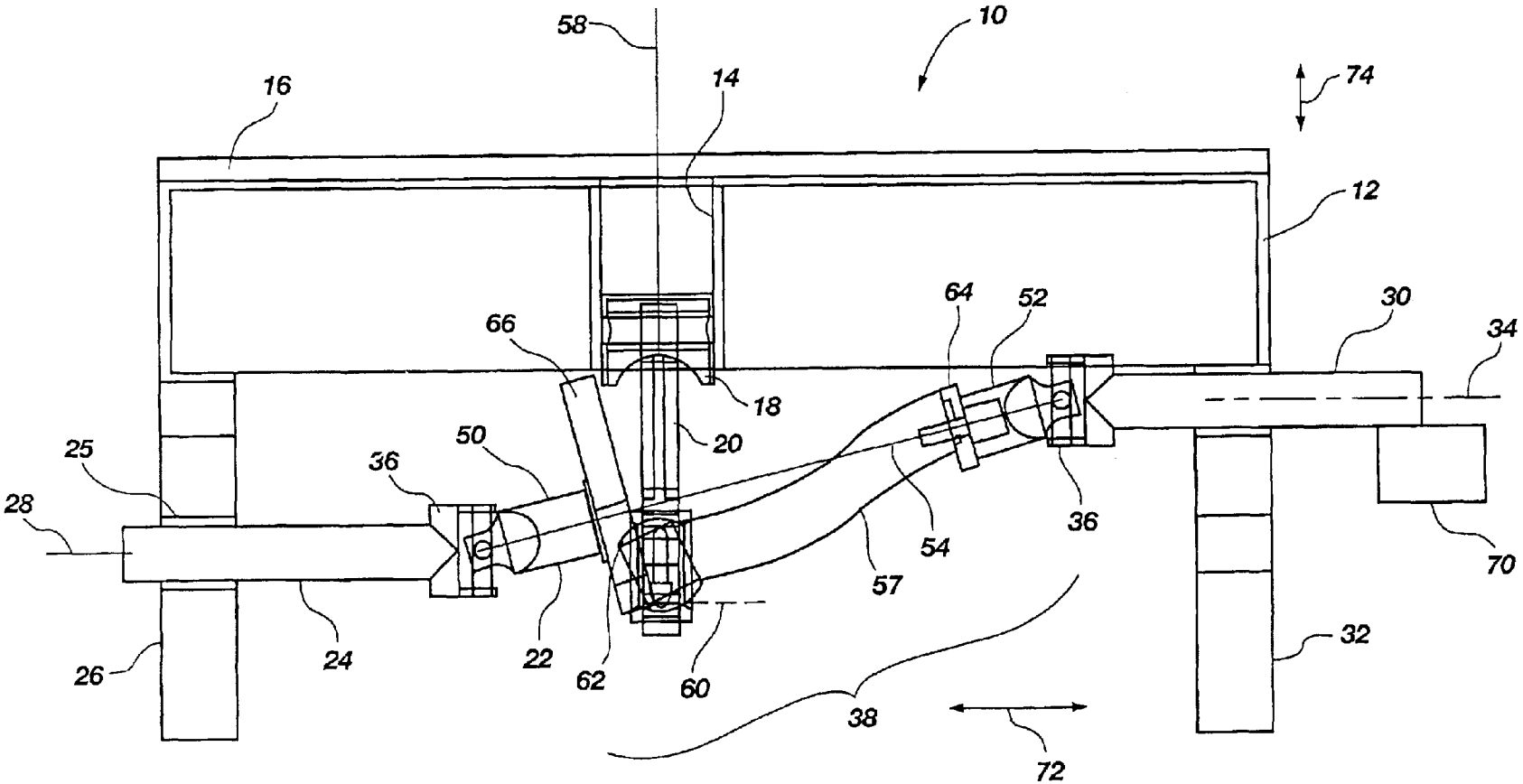
FIG. 1*e* is a break-away side view of a curved journal portion embodiment of the invention with the piston in a long stroke, top dead center position.

Similarly, the journal portion 56 may extend at any angle α from the third axis of rotation in a range of between approximately 0 degrees and approximately 90 degrees. In one embodiment, the angle α may be configured in a range of between approximately 5 degrees and approximately 20 degrees. For example, a crankshaft 22 having a journal portion 56 extending at an angle α of approximately 12 degrees has been demonstrated to exhibit excellent working capabilities for a particular application. However, it will be appreciated that the journal portion 56 may extend at other angles α within the scope of the present invention to meet the required stroke length variation needs for a particular use. For example, the stroke length variation requirements for a particular use may make various angles α suitable, such as angles α in ranges of between approximately 0–10 degrees, 10–20 degrees, 20–30 degrees, 30–40 degrees, 40–50 degrees, 50–60 degrees, 60–70 degrees, 70–80 degrees, or 80–90 degrees. For example, the journal portion 24 may extend at an angle α of approximately 5, 15, 25, 35, 45, 55, 65, 75, or 85 degrees or any other angle depending upon the particular stroke length variation requirements for a given situation. It will also be appreciated that the a curved journal portion 57 may be used within the scope of the present invention, as shown in FIG. 1*e*.

The journal portion 56 may have any cross sectional shape, such as round, oblong 56*c*, triangular 56*d*, square 56*e*, rectangular 56*f*, or I-beam shape 56*g*, for example, as shown in FIGS. 20*a*–20*f*, or any other suitable shape. Moreover, the journal portion 56 may have either a solid or hollow configuration and may have a uniform cross sectional shape along the length of the journal portion 56.

A spherical bearing 62 may be supported on the journal portion 56 and received by the connecting rod 20 to allow the journal portion 56 to slide with respect to the connecting rod 20. Accordingly, the spherical bearing 62 may be formed with an opening to receive the journal portion 56. The second end 52 of the angled segment 38 of the crankshaft 22 may have a collar 64 to limit movement of the spherical bearing 62 along the journal portion 56, or to limit movement of the crankshaft 22 with respect to the connecting rod 20. Movement of the spherical bearing 62 along the journal portion 56 may be limited at the first end 50 of the angled segment 38 by the counterweight 66. It will be appreciated that the counterweight 66 and or collar 64 may be positioned on the opposite ends of the angled segment 38 as those described above, or that counterweights 66 or collars 64 may be placed on both ends of the angled segment 38.

Figure 21:
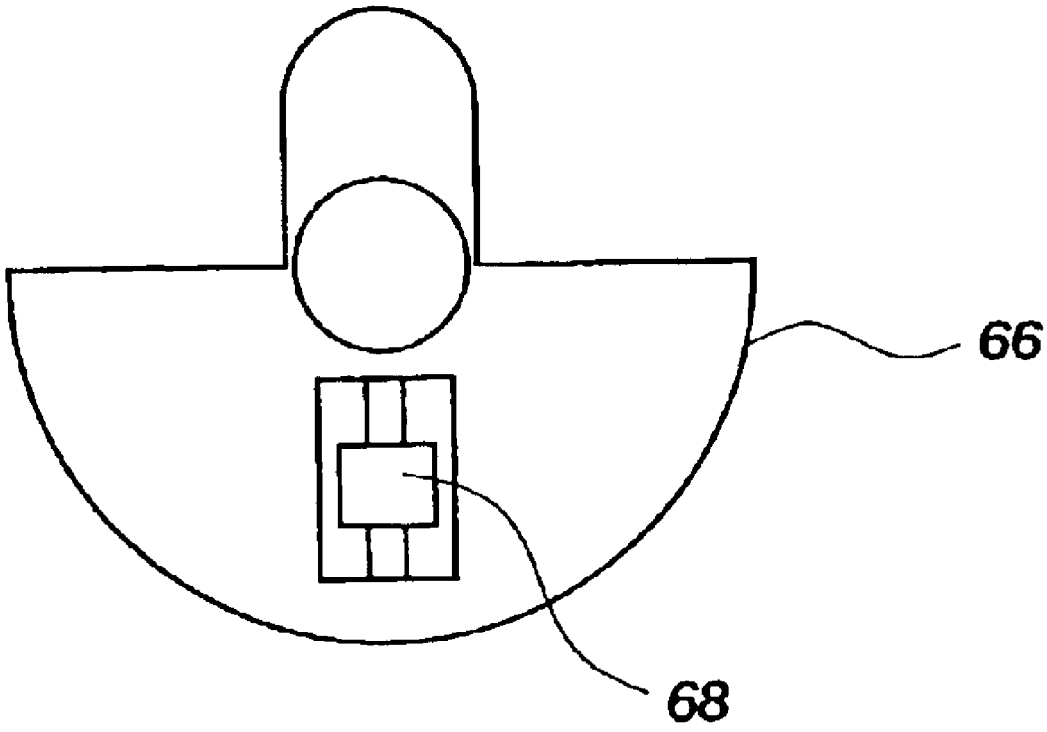
FIG. 21 is an end view of a counterweight having an adjustable weight.
Figure 22:
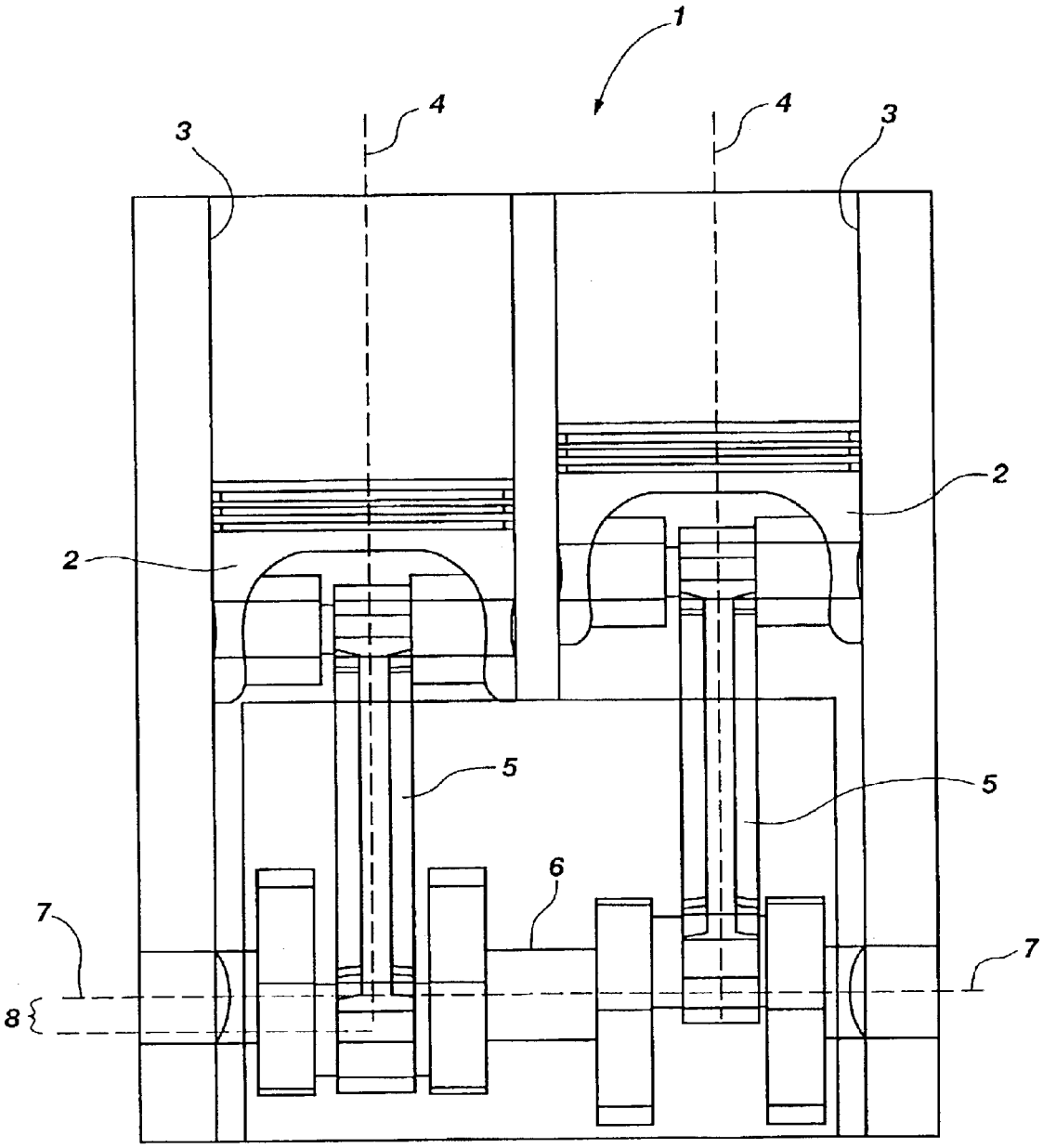
FIG. 22 (PRIOR ART)
FIG. 22 is a break-away side view of a prior art engine.

The counterweight 66 may be positioned on the crankshaft 22 for balancing the rotational forces of the crankshaft 22 as the crankshaft 22 is rotated. The counterweight 66 may have various shapes known to those skilled in the art, such as a segment of a disk for example. It will be appreciated that the counterweight 66 may be positioned at various locations along the crankshaft 22, including near the first end 50 of the angled segment 38, or near the second end 52 of the angled segment 38. Moreover, multiple counterweights 66 may be positioned on the crankshaft 22, as shown in FIGS. 5*a*–7*b* for example, within the scope of the present invention. The counterweight 66 may be a solid member having no moving parts, or the counterweight 66 may have adjustable weights 68, as shown in FIG. 21, attached thereto either on the exterior of the counterweight 66 or within a cavity inside the counterweight 66. The adjustable weights 68 may be moved by any manner known in the art, such as by a threaded engagement or resilient means, to adjust the balance of the counterweight 66.

The engine 10 may also include a means 70 for moving the crankshaft 22. The means 70 for moving the crankshaft 22 is shown schematically in FIG. 1*a*, and may include any mechanism known in the art such as a screw or gear type arrangement, or a hydraulic cylinder arrangement, for example. The means 70 for moving the crankshaft 22 may be configured to move the crankshaft 22 in a longitudinal direction of the crankshaft 22 indicated by arrows 72 to thereby adjust the position of the connecting rod 20 on the journal portion 56 of the crankshaft 22. It will be understood that the means 70 for moving the crankshaft 22 will provide for movement of the crankshaft 22 such that the journal portion 56 can be moved in three dimensions. For example, the crankshaft 22 may be moved in the longitudinal directions 72 while the crankshaft 22 is rotated thereby causing the journal portion 56 to be moved radially with respect to the third axis of rotation 54 such that movement of the journal portion 56 occurs in three dimensions.

As the piston 18 reciprocates, crankshaft 22 may be rotated such that the angled segment 38 rotates about the third axis of rotation 54. The piston 18 reciprocates between a bottom dead center position, or extreme bottom of the piston stroke as shown in FIG. 1*a*, and a top dead center position, or extreme top of the piston stroke as shown in FIG. 1*b*. It will be appreciated that the stroke length between the top dead center position and the bottom dead center position is determined by the radial length 55 of the connecting rod 20 on the journal portion 56 from the third axis of rotation 54 between the point when the journal portion 56 is in an upper position as shown in FIG. 1*b* and when the journal portion 56 is in a lower position as shown in FIG. 1*a*. Since the radial distance 55 between the journal portion 56 and the third axis of rotation 54 increases toward the first end 50 of the angled segment 38, the stroke length of the piston 18 is increased when the journal portion 56 is positioned in the connecting rod 20 near the first end 50. Accordingly, a long stroke length is depicted in FIGS. 1*a* and 1*b*. As crankshaft 22 is moved such that the connecting rod 20 is positioned toward the second end 52 of the angled segment 38 as shown in FIGS. 1*c* and 1*d*, the stroke length of the piston is reduced. As can be observed by inspection of FIGS. 1*c*, where the piston 18 is positioned at the bottom dead center position, as compared to FIG. 1*d*, where the piston 18 is positioned at the top dead position, the stroke length of the piston is reduced as compared to the stroke length shown in FIGS. 1*a* and 1*b*.

The engine 10 may be configured and arranged such that when the piston 18 in FIG. 1*b* resides in its top dead center position as shown, the journal portion 56 of the crankshaft 22 is disposed at a non-zero angle beneath and with respect to the line 60 that is perpendicular with the movement axis 58 of the piston 18.

Accordingly, it will be appreciated that the stroke length of the piston 18 may be adjusted by moving the crankshaft 22 in the direction of arrow 72 with respect to the piston 18 and connecting rod 20 to thereby adjust the radial distance 55. When the crankshaft 22 is moved with respect to the connecting rod 20, the cylinder 14 may act as a guide to hold the piston 18 in place so that the piston 18 does not follow the movement of the crankshaft in the direction 72. Alternatively, it will also be understood that the crankshaft 22 may remain stationary and the engine block 12 containing the piston 18 and connecting rod 20 may be moved with respect to the crankshaft 22.

Accordingly, the stroke length may be adjusted to provide optimal power or efficiency in a continuous manner during operation of the engine 10. The operating conditions of the engine 10 may be monitored by a computerized system as is known in the art and the stroke length may be adjusted accordingly. For example, a longer stroke length may be beneficial for a certain power requirement placed on the engine. This condition may be detected and the stroke length may be automatically adjusted accordingly. Alternatively, the engine 10 may also be configured such that the stroke length may be adjusted manually by the engine operator in accordance with the desired performance characteristics of the operator.

Figure 1F:
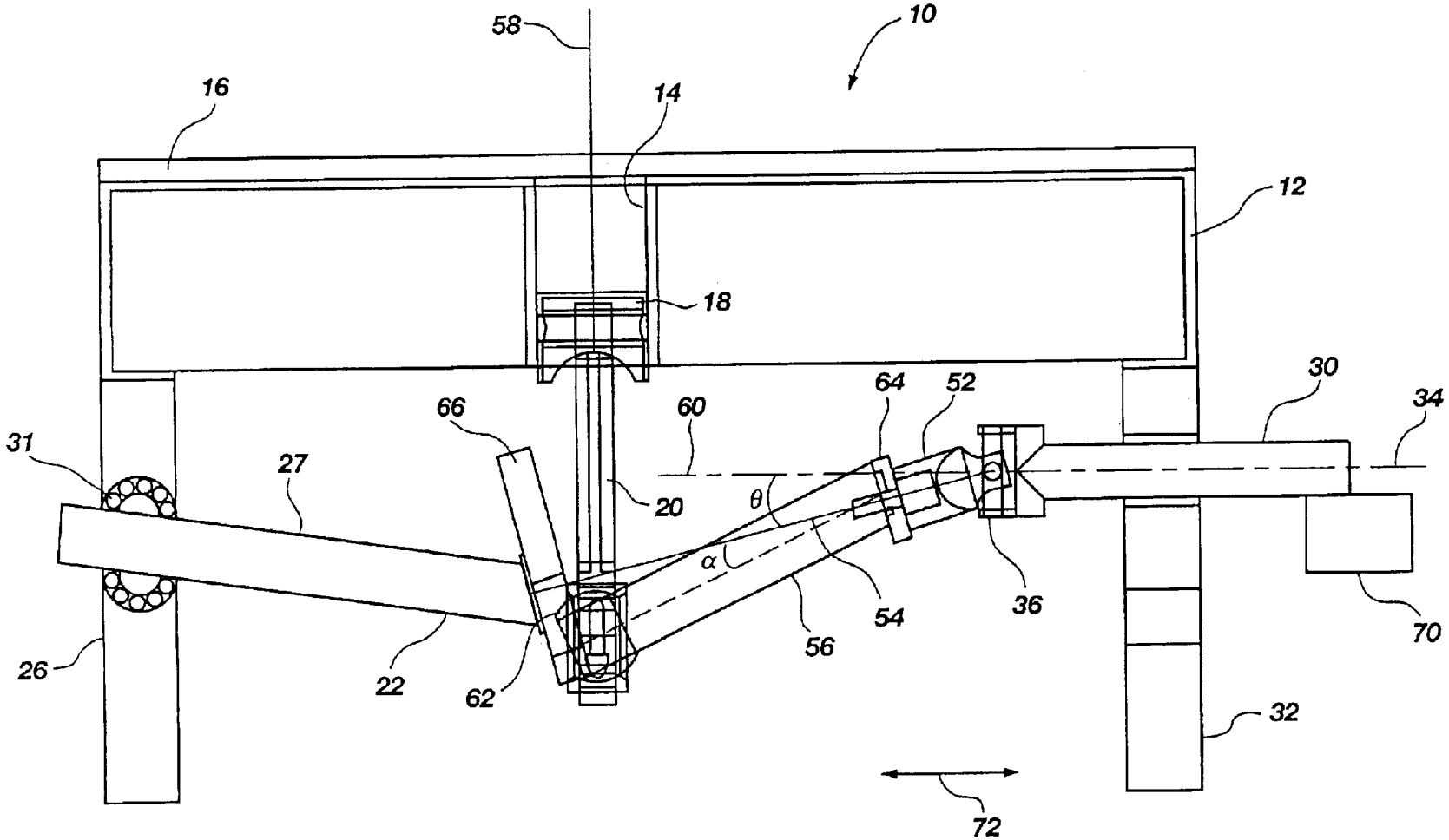
FIG. 1*f* is a break-away side view of an embodiment of the invention configured to maintain a constant distance from the head to the piston at the top dead center position.

It will be appreciated that the engine 10 also may be configured in certain embodiments to maintain a constant distance between the piston 18 and the engine head 16 when the piston 18 is in a top dead center position at any location along the length of the journal portion 56. For example, the crankshaft 22 may have an angled offset portion 27 as shown in FIG. 1*f*. The angled offset portion 27 may be configured at an angle to adjust the distance between the crankshaft 22 and the engine head 16 as the crankshaft 22 is moved in the longitudinal direction 72. Thus, the angled offset portion 27 may be configured to compensate for the changes in distance from the piston 18 to the engine head 16 produced by adjustments of the position of the connecting rod 20 along the journal portion 56. It will also be appreciated that the angle θ of the third axis of rotation 54, and the angle α of the journal portion 56 may also be selected to maintain a constant distance from the piston 18 to the engine head 16, at the top dead center position, as the crankshaft 22 is moved in the longitudinal direction 72 with respect to the connecting rod 20.

Figure 2:
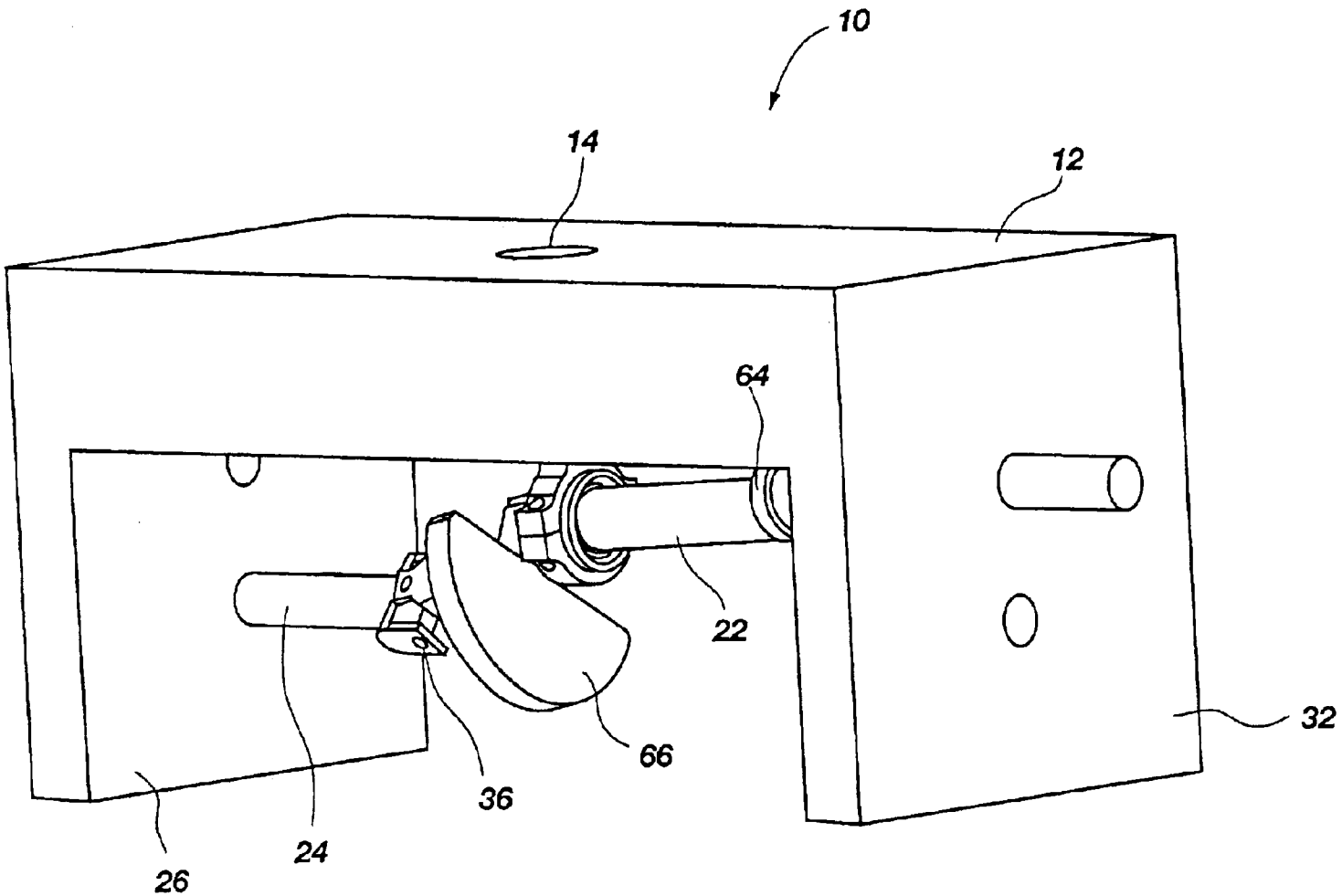
FIG. 2 is a perspective view of the embodiment of FIG. 1*b;*

As is clearly shown in the embodiment of FIGS. 4*a*–4*d*, the principles of the present invention may be used in an engine 10*b* with multiple pistons, including a first piston 18*a*, and a second piston 18*b* on the crankshaft 22. As previously discussed, the presently described embodiments of the invention illustrated herein are merely exemplary of the possible embodiments of the invention, including that illustrated in FIGS. 4*a*–4*d*. It will be appreciated that the embodiment of the invention illustrated in FIGS. 4*a*–4*d* contains many of the same structures represented in FIGS. 1–3 and only the new or different structures will be explained to most succinctly explain the additional advantages which come with the embodiment of the invention illustrated in FIGS. 4*a*–4*d*.

The first piston 18*a* and the second piston 18*b* may be spaced apart along the length of the journal portion 56 such that the first piston 18*a* and the second piston 18*b* have different stroke lengths. As can be seen by inspection of FIGS. 4*a* and 4*c*, wherein the first piston 18*a* and the second piston 18*b* are in a bottom dead center position, the stroke length of the first piston 18*a* is longer than the stroke length of the second piston 18*b*. This configuration may provide different operating characteristics for each of the first piston 18*a* and the second piston 18*b*. For example, the second piston 18*b* may be virtually turned off as can be seen by inspection of the position of second piston 18*b* in FIGS. 4*c* and 4*d*, which show the second piston 18*b* in the bottom dead center and top dead center positions respectively at a short stroke position on the journal portion 56. That is, the second piston 18*b* may be positioned on the journal portion 56 such that it has substantially no stroke length. This may be beneficial in certain engine operating conditions where little energy consumption and or power is needed. This configuration may apply less drag on the engine since second piston 18*b* is not required to travel along a stroke length that would add the frictional resistance that occurs as a piston travels in a cylinder.

Figure 5A:
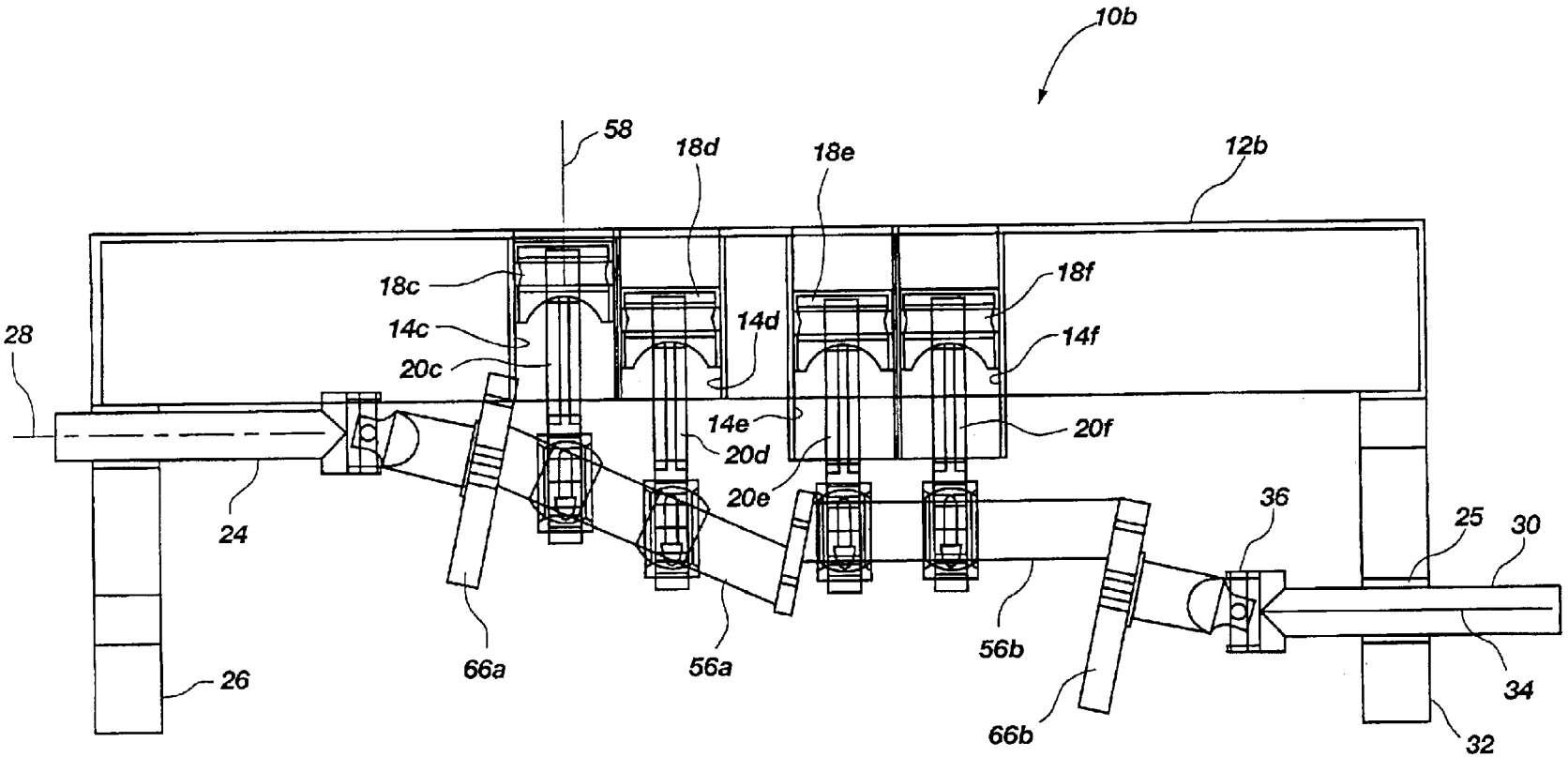
FIG. 5*a* is a break-away side view of an alternative embodiment of the present invention having multiple journal portions and four pistons.
Figure 5B:
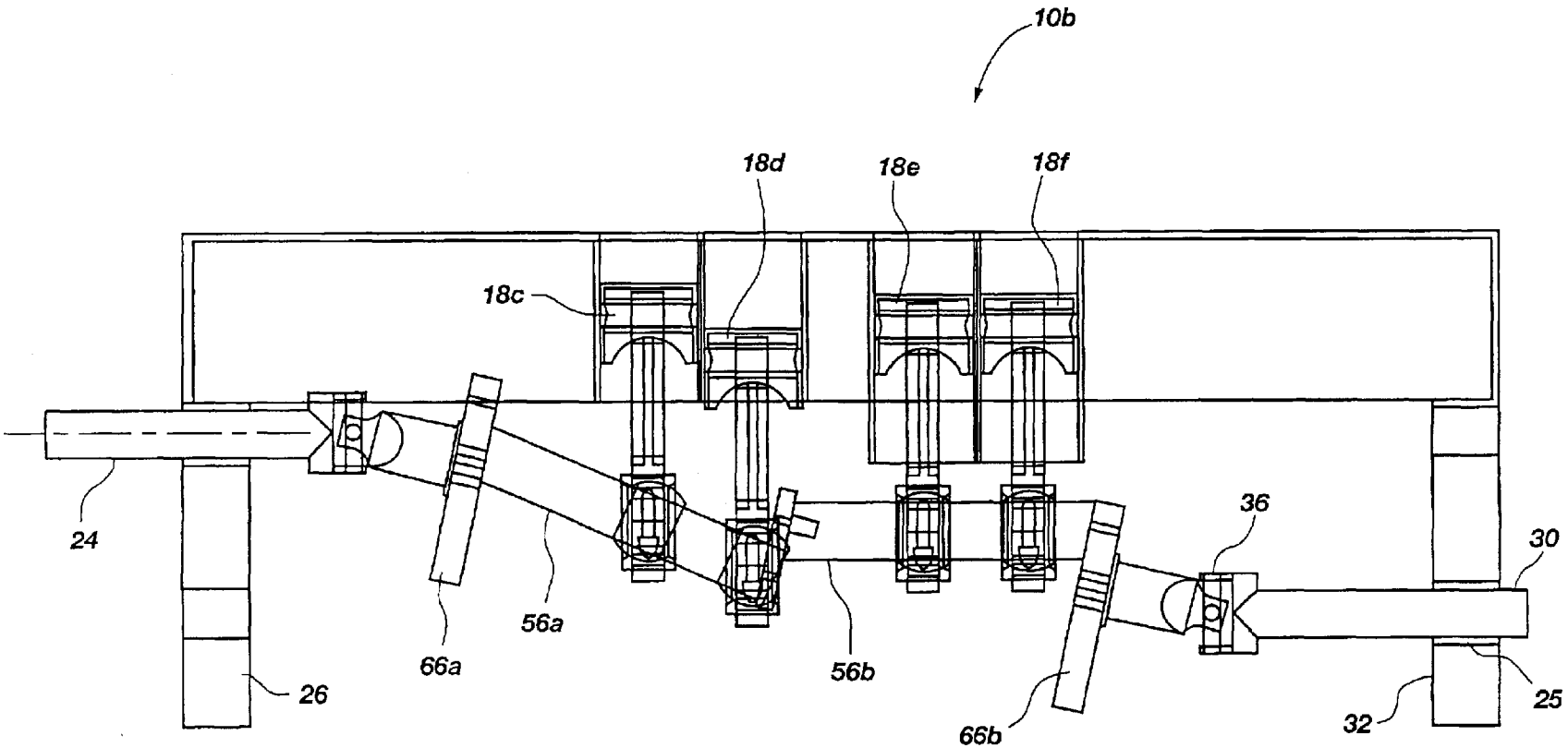
FIG. 5*b* is a break-away side view of the embodiment of FIG. 5*a* with the crankshaft in an adjusted position.
Figure 6:
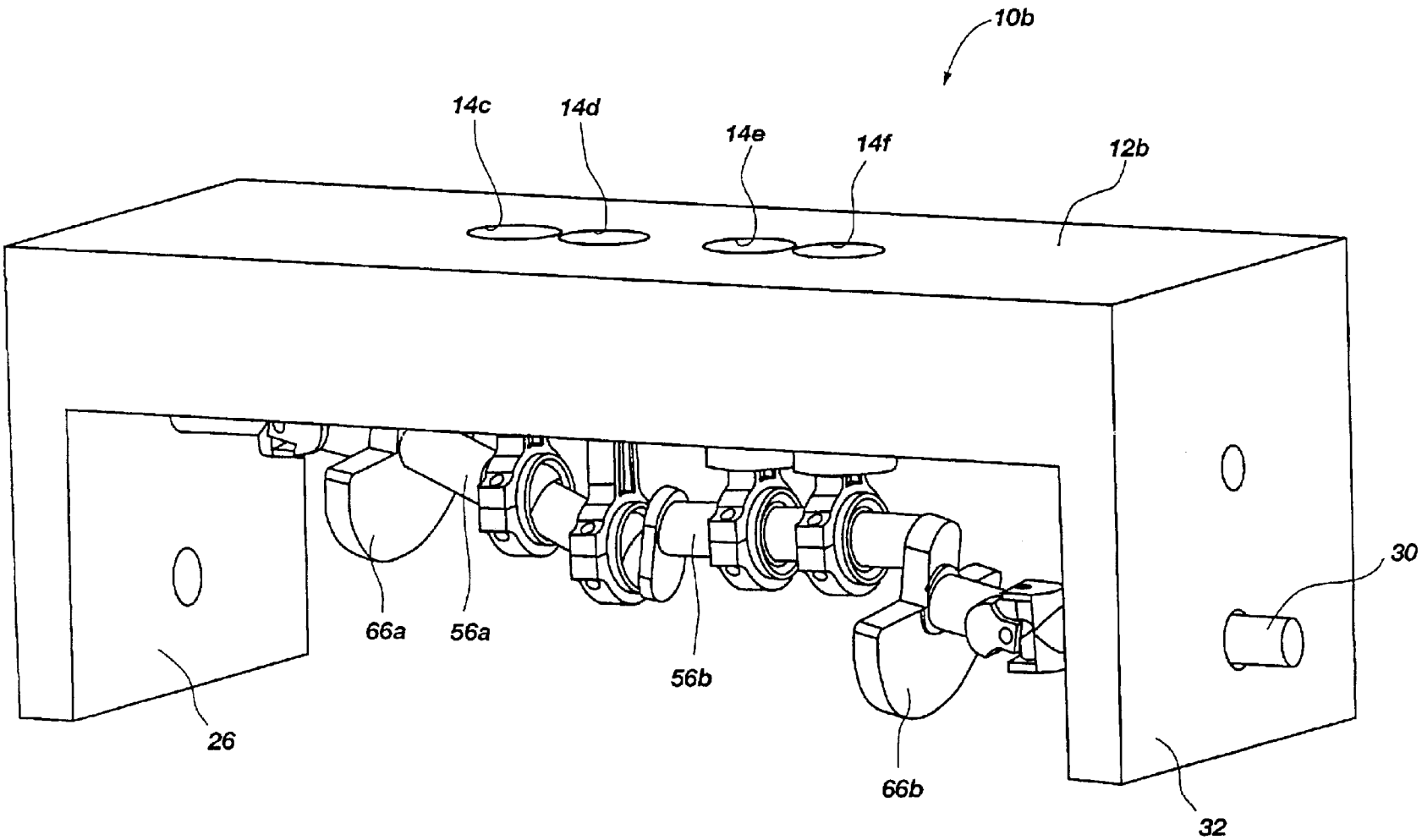
FIG. 6 is a perspective view of the embodiment of FIG. 5*b;*

Referring now to FIGS. 5*a*, 5*b* and 6, an additional alternative embodiment engine 10*b* is shown having four pistons, including a first piston 18*c*, a second piston 18*d*, a third piston 18*e* and a fourth piston 18*f*. The engine 10*b* also may include a plurality of journal portions including a first journal portion 56*a*, and a second journal portion 56*b*. It will be appreciated that the embodiment of the invention illustrated in FIGS. 5*a*, 5*b* and 6 contains many of the same structures represented in FIGS. 1–4*d* and only the new or different structures will be explained to most succinctly explain the additional advantages which come with the embodiment of the invention illustrated in FIGS. 5*a*, 5*b* and 6.

The multiple piston configuration and plurality of journal portions 56*a*, 56*b* may enable the engine 10*b* to be configured for various torque, power, and efficiency conditions. As described above, one or more of the pistons may be turned off. Also, the journal portions 56*a*, 56*b* may be configured at different angles such that movement of the crankshaft 22*b* may adjust the stroke length of each of the pistons 18*c*–18*f* differently. It will be appreciated that the present invention may be used with any number of pistons and journal portions within the scope of the present invention.

As is shown in the embodiment of FIG. 7*a*, the crankshaft 22*c* may be formed in a rigid manner without the use of universal connections. Accordingly, the first end portion 24*c* and the second end portion 30*c* may be aligned coaxially. It will be understood that the engine head may include adjustable head portions, as shown in phantom lines at 16*a*, said head portions 16*a* when present being adjustable in the direction of arrows 74 in FIG. 7*a* such that the compression ratio of the cylinder 14 may remain the same or be different as desired as the stroke distance is adjusted, within the scope of the present invention. Accordingly, the optimal compression ratio may be achieved. The engine head 16*a* may be adjusted in any manner known to those skilled in the art.

Figure 7B:
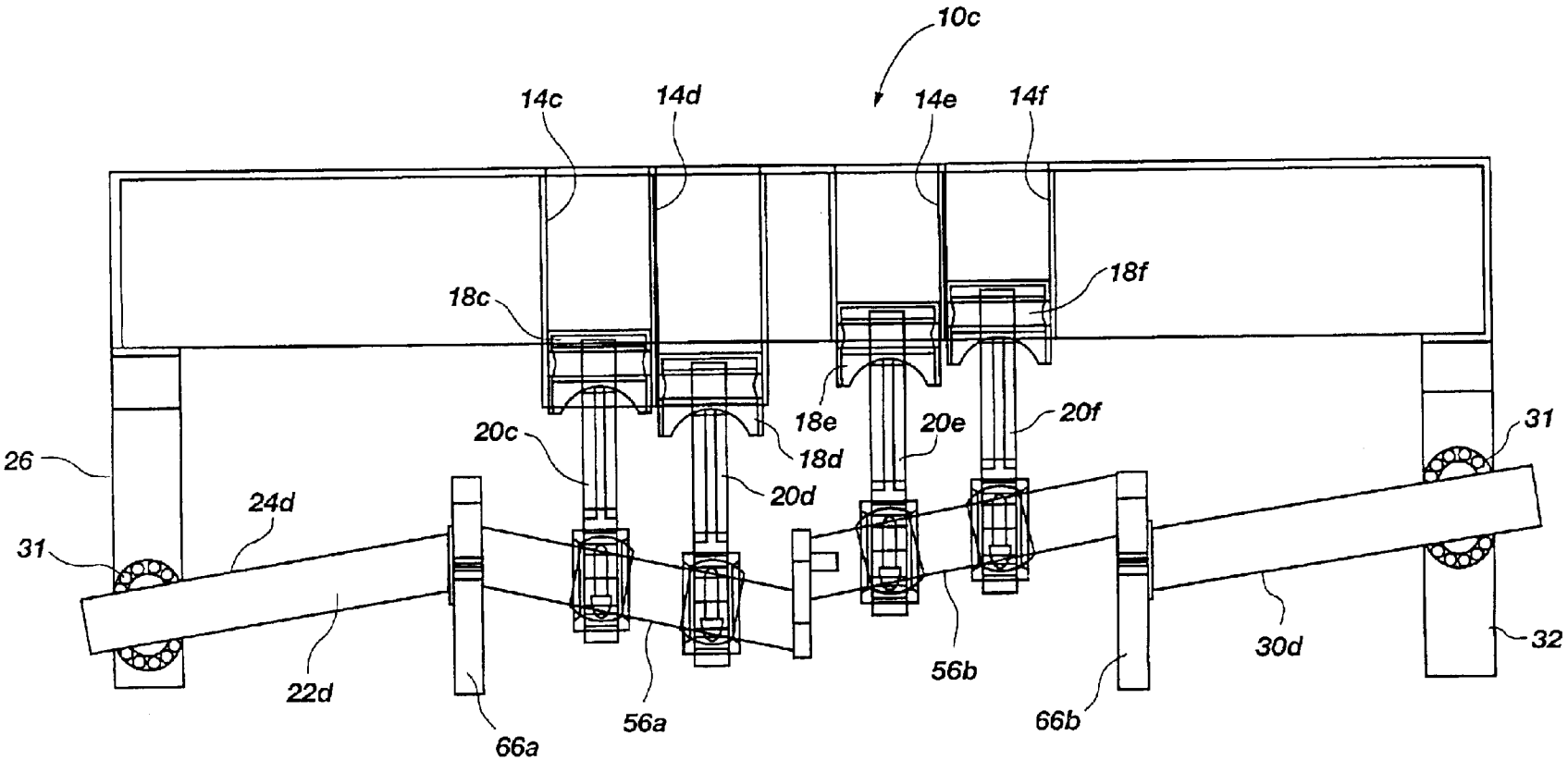
FIG. 7*b* is a break-away side view of an alternative embodiment of the present invention having multiple journal portions and a crankshaft without universal connections supported by bearing holding means.

As shown in FIG. 7*b*, it will also be understood that the first end portion 24*d* and the second end portion 30*d* may intersect the first side support 26 and second side support 32 at non-perpendicular angles and that spherical or eccentric bearing holding means 31 may be used to support the crankshaft 22*d* at the first side support 26 and the second side support 32.

Figure 19:
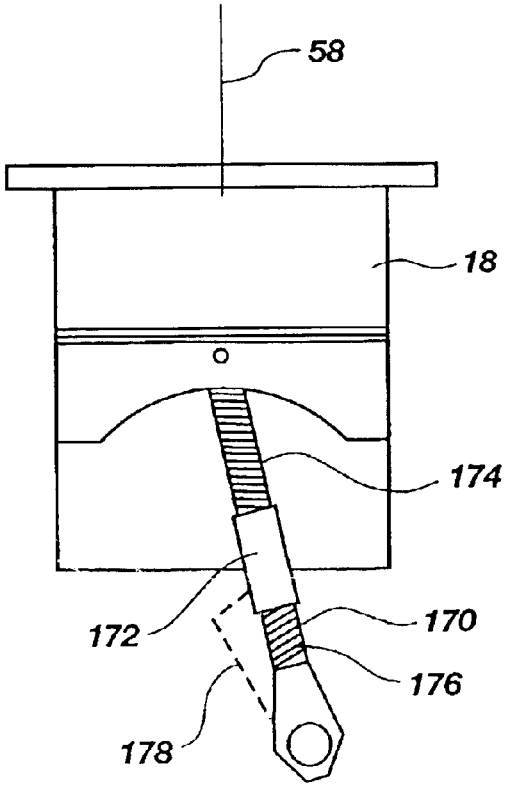
FIG. 19 is a side schematic view of a piston having an alternative embodiment connecting rod.
Figure 20A:
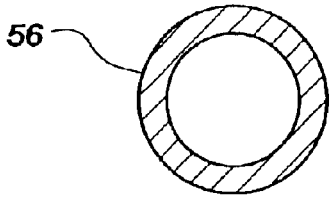
FIG. 20*a* is a cross-section of an embodiment of the journal portion.
Figure 20B:
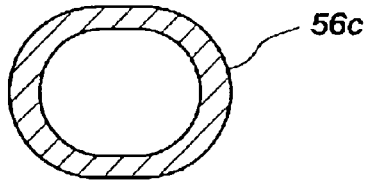
FIG. 20*b* is a cross-section of an alternative oblong embodiment journal portion.
Figure 20C:
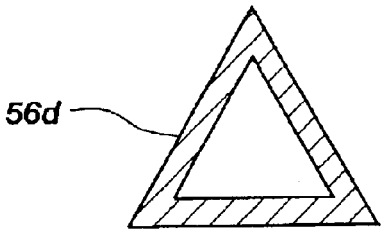
FIG. 20*c* is a cross-section of an alternative triangular embodiment journal portion.
Figure 20D:
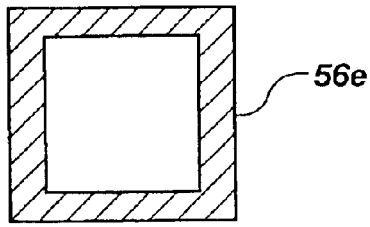
FIG. 20*d* is a cross-section of an alternative square embodiment journal portion.
Figure 20E:
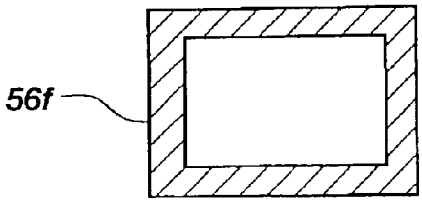
FIG. 20*e* is a cross-section of an alternative embodiment rectangular journal portion.
Figure 20F:
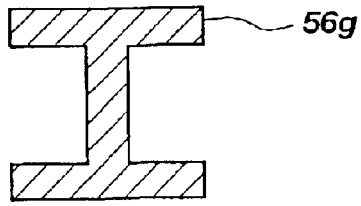
FIG. 20*f* is a cross-section of an alternative embodiment "I" beam journal portion.

Referring to FIG. 19, a piston 18 is shown with an adjustable connecting rod 170. The adjustable connecting rod 170 may comprise any suitable means 172 for varying the length of the connecting rod 170. For example, the means 132 for varying the length of the adjustable connecting rod 170 may comprise a female-threaded sleeve which threadably engages with, and thereby inter-couples together, male-threaded portions 174 and 176 of the connecting rod 170. A lengthening device 178, represented schematically in FIG. 19, may comprise any suitable means for rotating the sleeve 172 to increase the length of the adjustable connecting rod 170. Accordingly, the stroke length of the piston 18 having the adjustable connecting rod 170 may be adjusted even with a crankshaft arranged perpendicular to the movement axis 58 of the piston 18. Moreover, the adjustable connecting rod 170 may be used in combination with an angled crankshaft segment 38 to modify or maintain a desired compression ratio.

It will be understood that the stroke length of the pistons 18 may be modified while the engine 10 is in operation. Similarly, the stroke length of the pistons 18 may be modified while the engine is at rest. Moreover, the stroke length may be continuously variable or variable at multiple set positions within the scope of the present invention.

Figure 8:
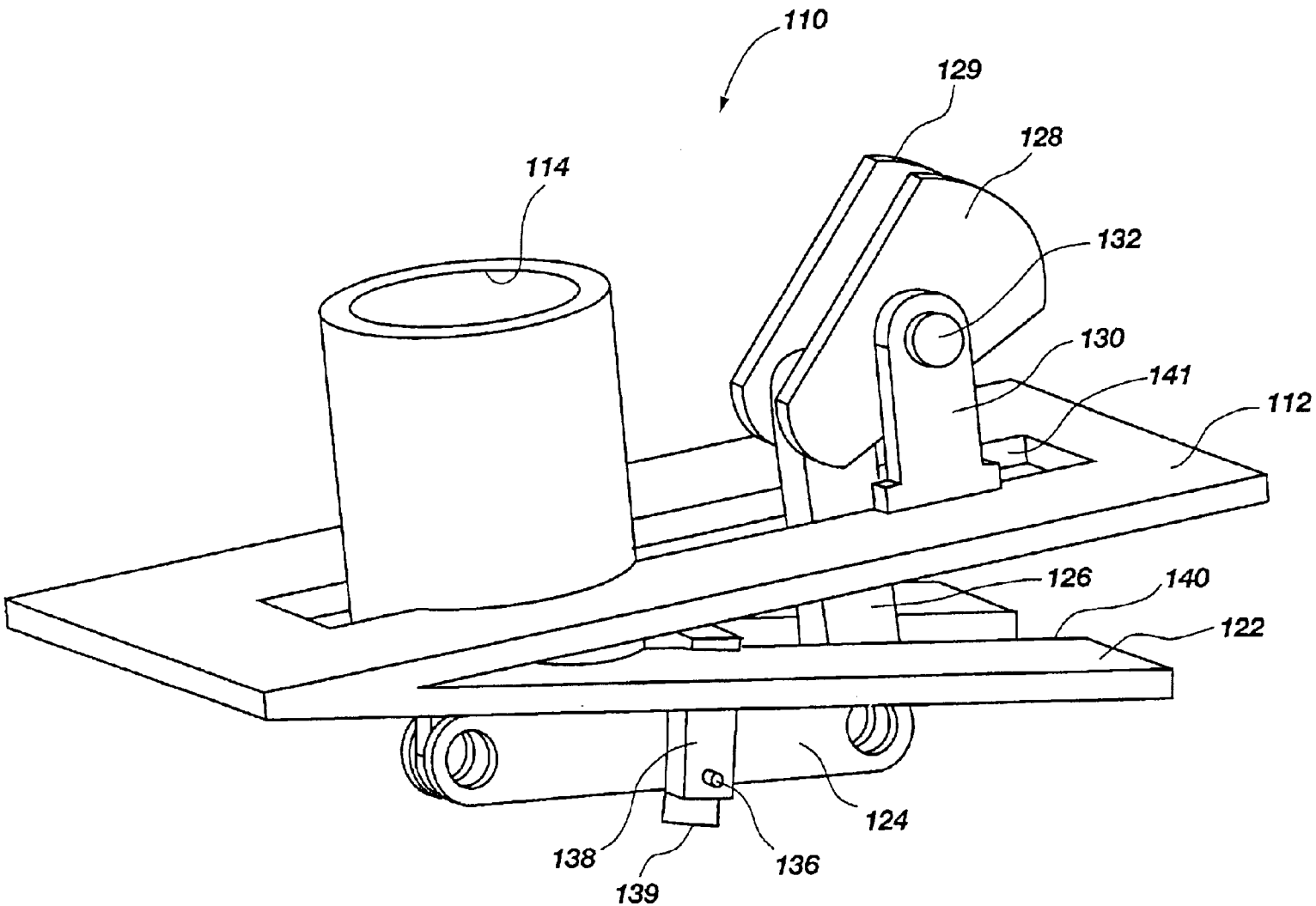
FIG. 8 is a perspective view of an alternative embodiment of the present invention utilizing a fulcrum.
Figure 9:
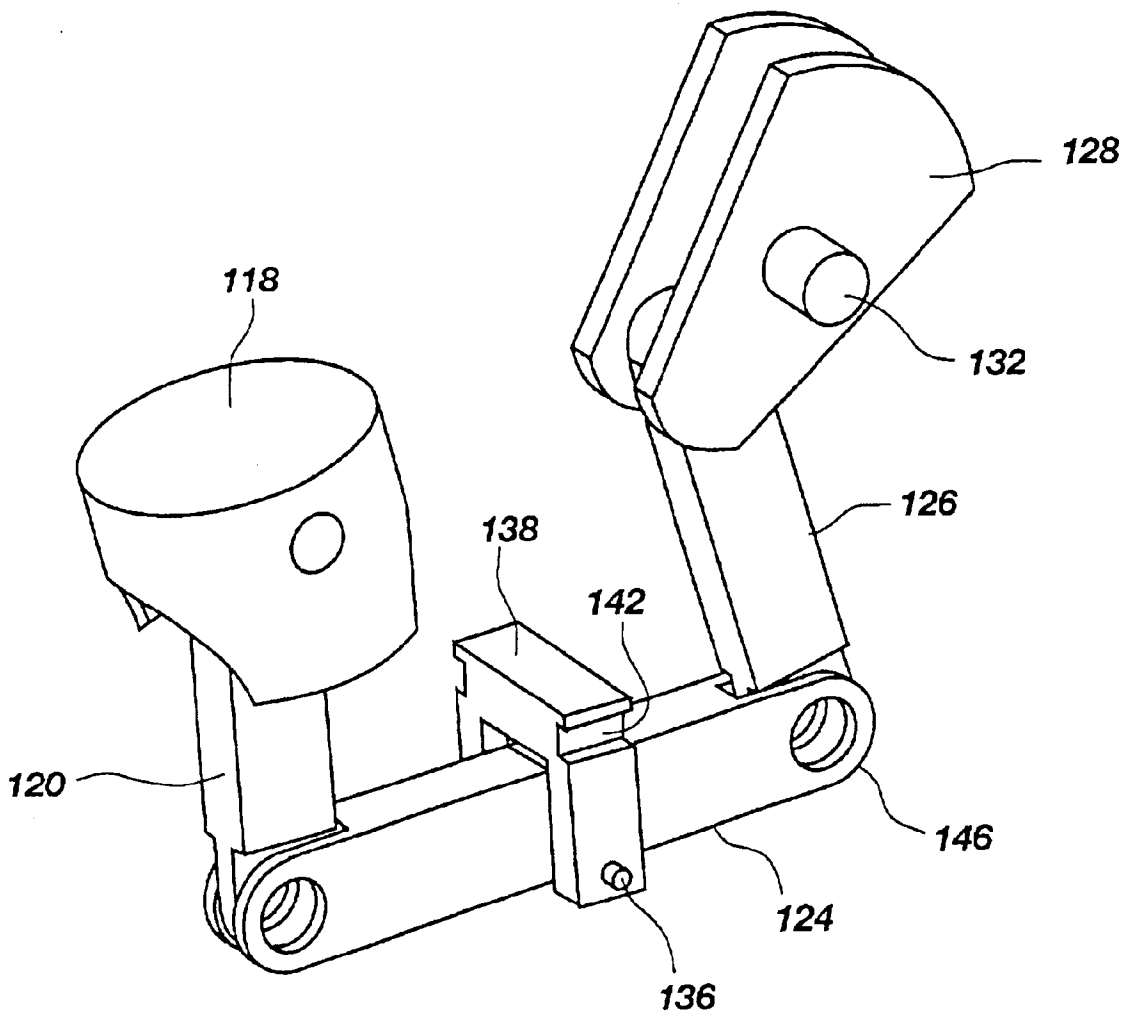
FIG. 9 is a perspective view of the piston and linkage of the embodiment of FIG. 8.
Figure 10:
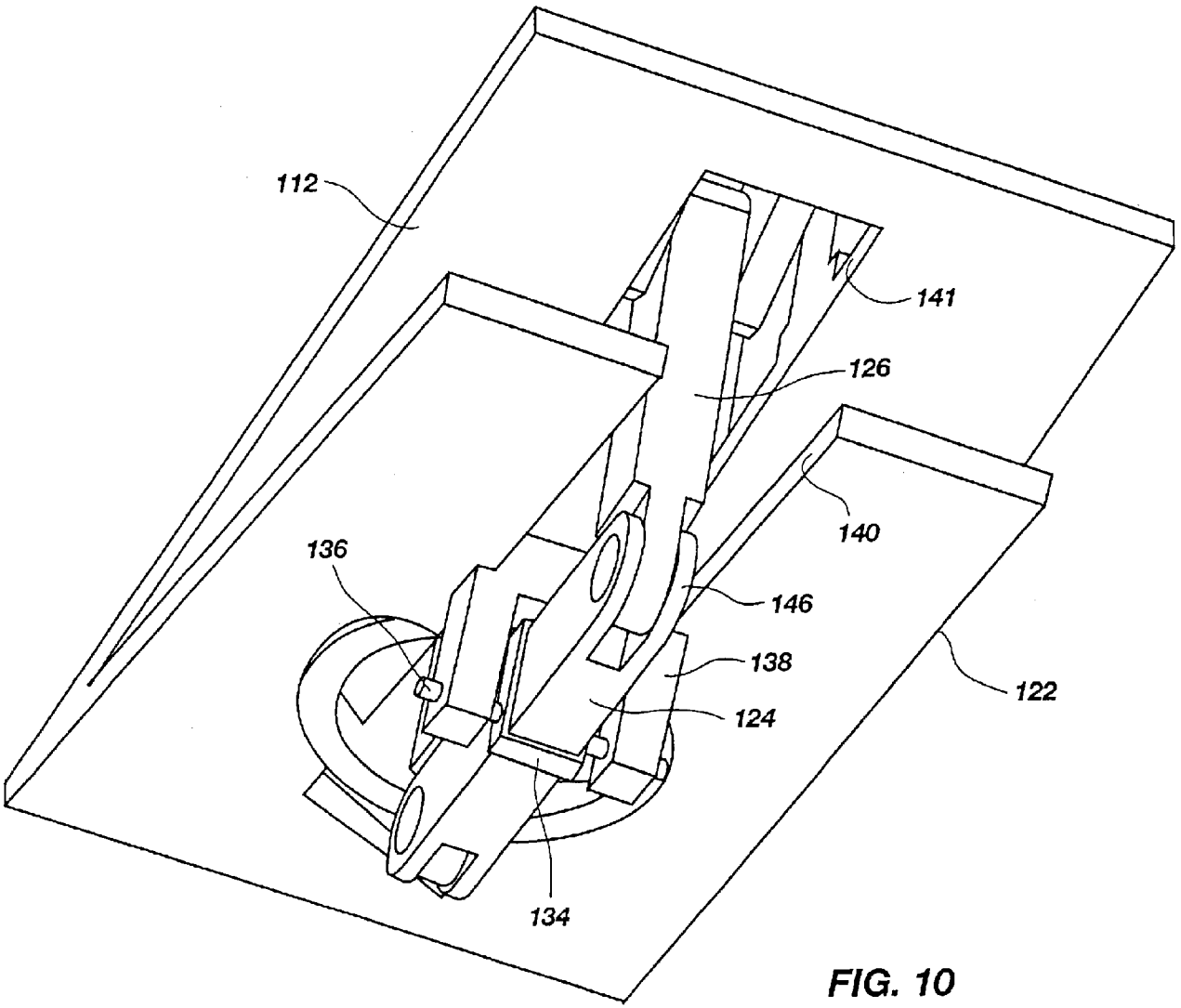
FIG. 10 is an enlarged perspective view of the bottom of the linkage of the embodiment of FIG. 8.

Referring now to FIGS. 8–10, a perspective view of an alternative embodiment engine 110 is shown. The engine 110 may include a base 112 supporting a cylinder 114 for receiving a piston 118. A connecting rod 120 may be attached to the piston 118 in a manner known in the art. An angular support 122 may extend from the base 112 at an angle β with respect to the base 112. It will be appreciated that the angular support 122 may be fixedly attached to the base 112 so that the angle β remains constant, or the angular support 122 may be adjustably attached to the base 112 so that the angle β can be varied. The angular support 122 may be arranged at an angle β with respect to the base 112 in a range of between approximately 0 degrees and approximately 90 degrees. In one embodiment, the angle β may be configured in a range of between approximately 5 degrees and approximately 20 degrees. For example, an angular support 122 arranged at an angle β with respect to the base 112 of approximately 12 degrees may be used for a particular application. However, it will be appreciated that the angular support 122 may extend at other angles β within the scope of the present invention to meet the required stroke length variation needs for a particular use. For example, the stroke length variation requirements for a particular use may make various angles β suitable, such as angles β in ranges of between approximately 0–10 degrees, 10–20 degrees, 20–30 degrees, 30–40 degrees, 40–50 degrees, 50–60 degrees, 60–70 degrees, 70–80 degrees, or 80–90 degrees. For example, the angular support 122 may extend may extend at an angle β of approximately 5, 15, 25, 35, 45, 55, 65, 75, or 85 degrees or any other angle depending upon the particular stroke length variation requirements for a given situation.

A first link member 124 may be pivotally attached to the connecting rod 120 at one end and pivotally connected to a second link member 126 at an opposite end. The second link member 126 may be pivotally attached to a counterweight member 128. The counterweight member 128 may have various different configurations within the scope of the present invention, such as a pair of opposing walls 129 spaced apart for receiving the second link member 126 therebetween. The counterweight member 128 may be supported by a brace member 130 and may be configured to rotate about an output member 132. The output member 132 may be a shaft, for example, supported on the brace member 130. It will be appreciated that the output member 132 may have other configurations within the scope of the present invention, such as a gear, disk, or sprocket, for example.

The first link member 124 may also be attached to a sleeve 134. The sleeve 134 may be configured as a hollow member to receive the first link 124 and to slide along the length of the first link member 124. A shaft 136 may be attached to the sleeve 134 and to a slider 138 so that the sleeve 134 may be configured to pivot with respect to the slider 138. It will be appreciated that the sleeve 134, the shaft 136, and the slider 138 may collectively form a fulcrum, indicated generally at 135, for supporting the first link member 124. An enlarged perspective view of the sleeve 134, the shaft 136 and the slider 138 is shown in FIG. 10.

The slider 138 may be attached to the angular support 122 so as to be movable along the length of the angular support 122. In one embodiment, the angular support 122 may have a support slot 140 for receiving the slider 138 and the second link member 126. The second link member 126 may also pass through a base slot 141 disposed in the base 112. The engine 110 may also comprise a means for adjusting the position of the slider 138 along the angular support 122 as shown schematically at 139. It will be appreciated that any means known in the art may be utilized to adjust the position of the slider 138 along the length of the angular support 122. For example, a threaded rod may be attached to the slider 138, such that the threaded rod may be rotated to adjust the position of the slider 138 through a screw type mechanism. Also, a hydraulic ram mechanism may be utilized to adjust the position of the slider 138 along the length of the angular support 122, as well as gears, chains, belts or any other mechanism known in the art for adjusting the position of one member with respect to another.

In operation, downward movement of the piston 118 causes the first link member 124 to pivot about the fulcrum 135 to cause upward movement of the second link member 126 which causes the counterweight member 128 to rotate about the output member 132. As the counterweight 128 continues its revolution around the output 132, the second link member 126 moves downwardly, the first link member pivots about the fulcrum 135 and the connecting rod 120 and piston 118 move upwardly in the cylinder 114.

The output member 132 may rotate to transmit the output through any variety of gear or transmission mechanisms known in the art for use in a variety of applications such as powering wheels of a vehicle for example. However, it will be appreciated that the output of the engine 110 may be available for any use known in the art.

Figure 8A:
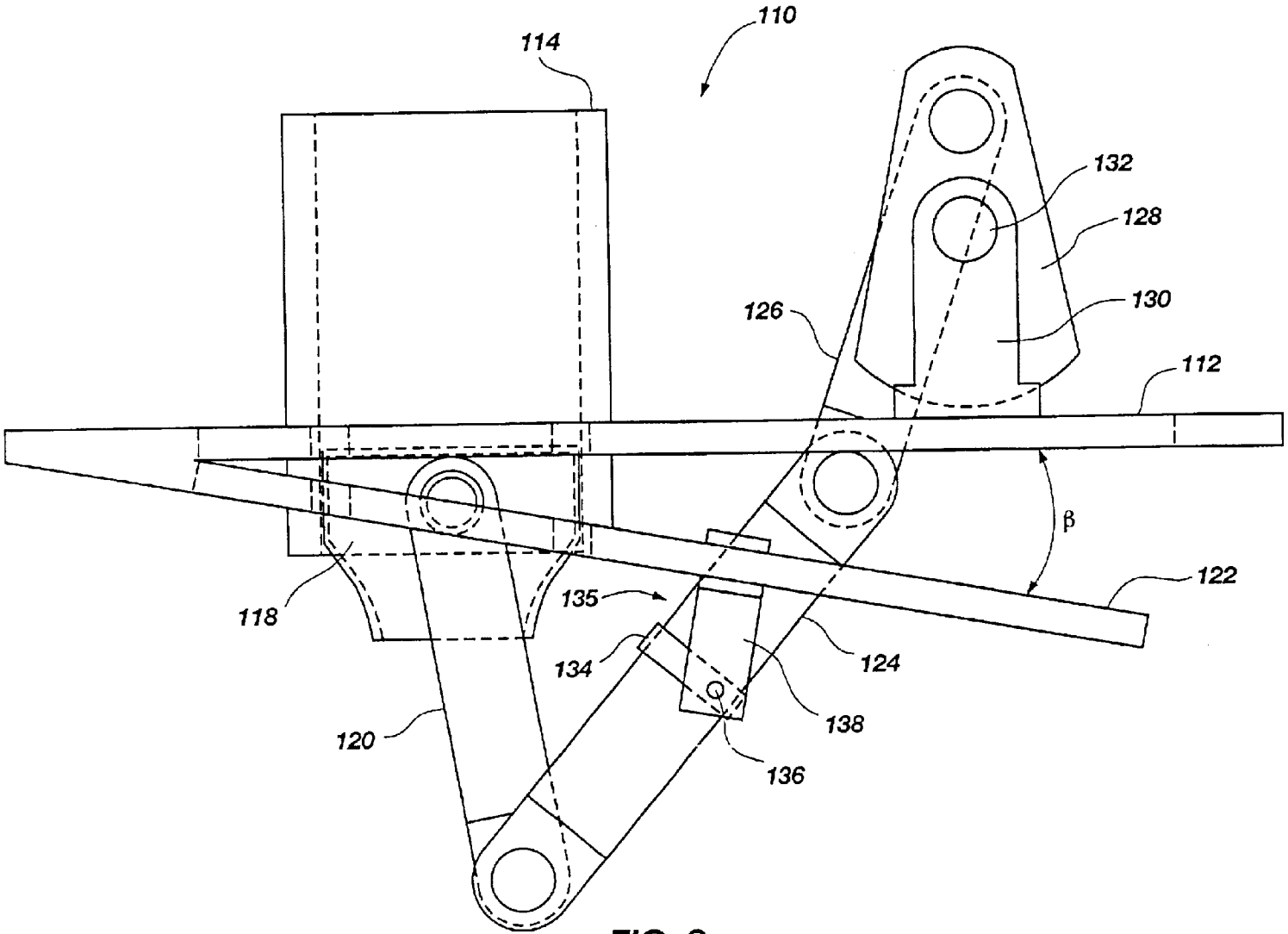
FIG. 8*a* is a break-away side view of the embodiment of FIG. 8, with the piston in a long stroke, bottom dead center position.
Figure 8B:
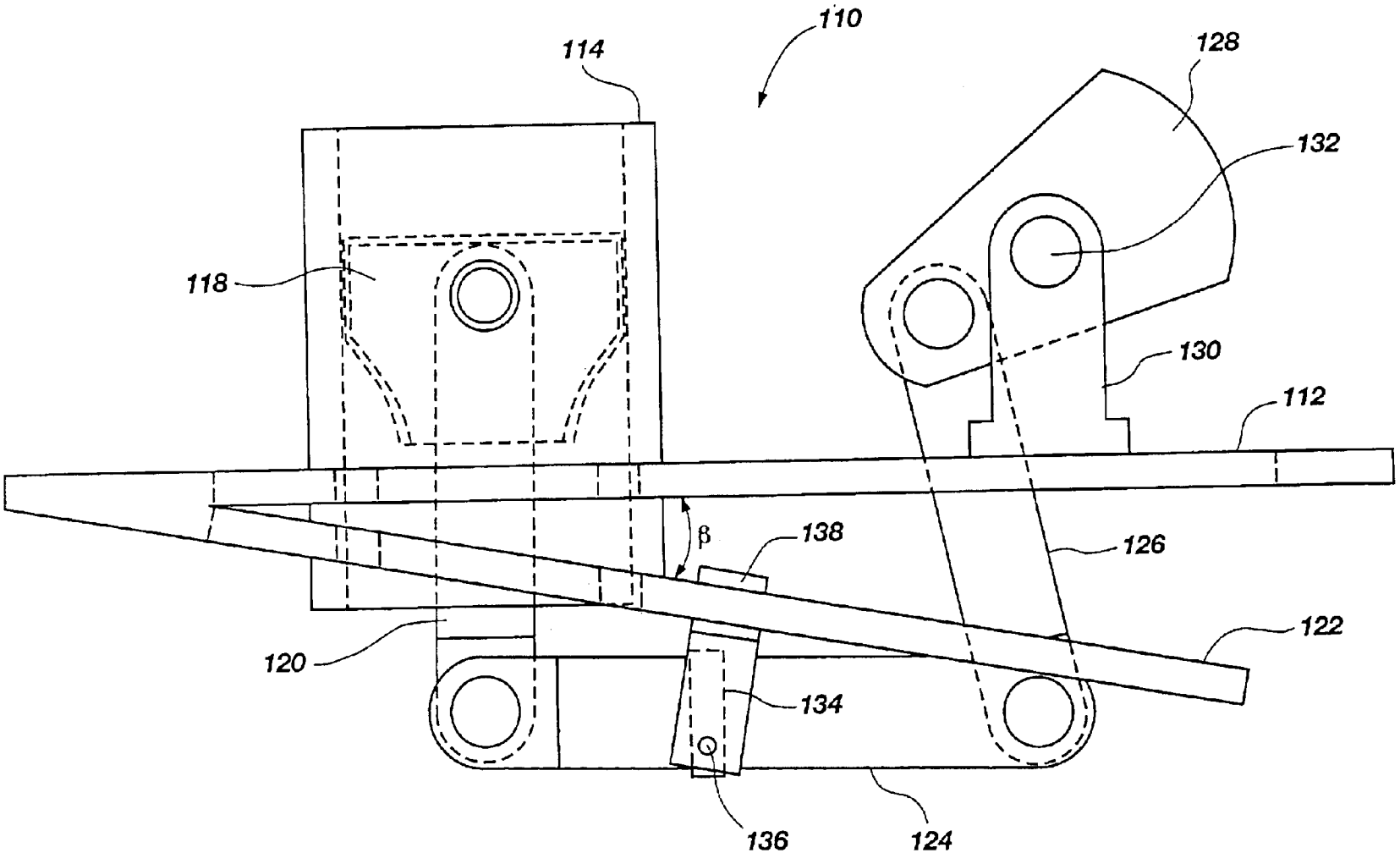
FIG. 8*b* is a break-away side view of the embodiment of FIG. 8, with the piston in an intermediate position.
Figure 8C:
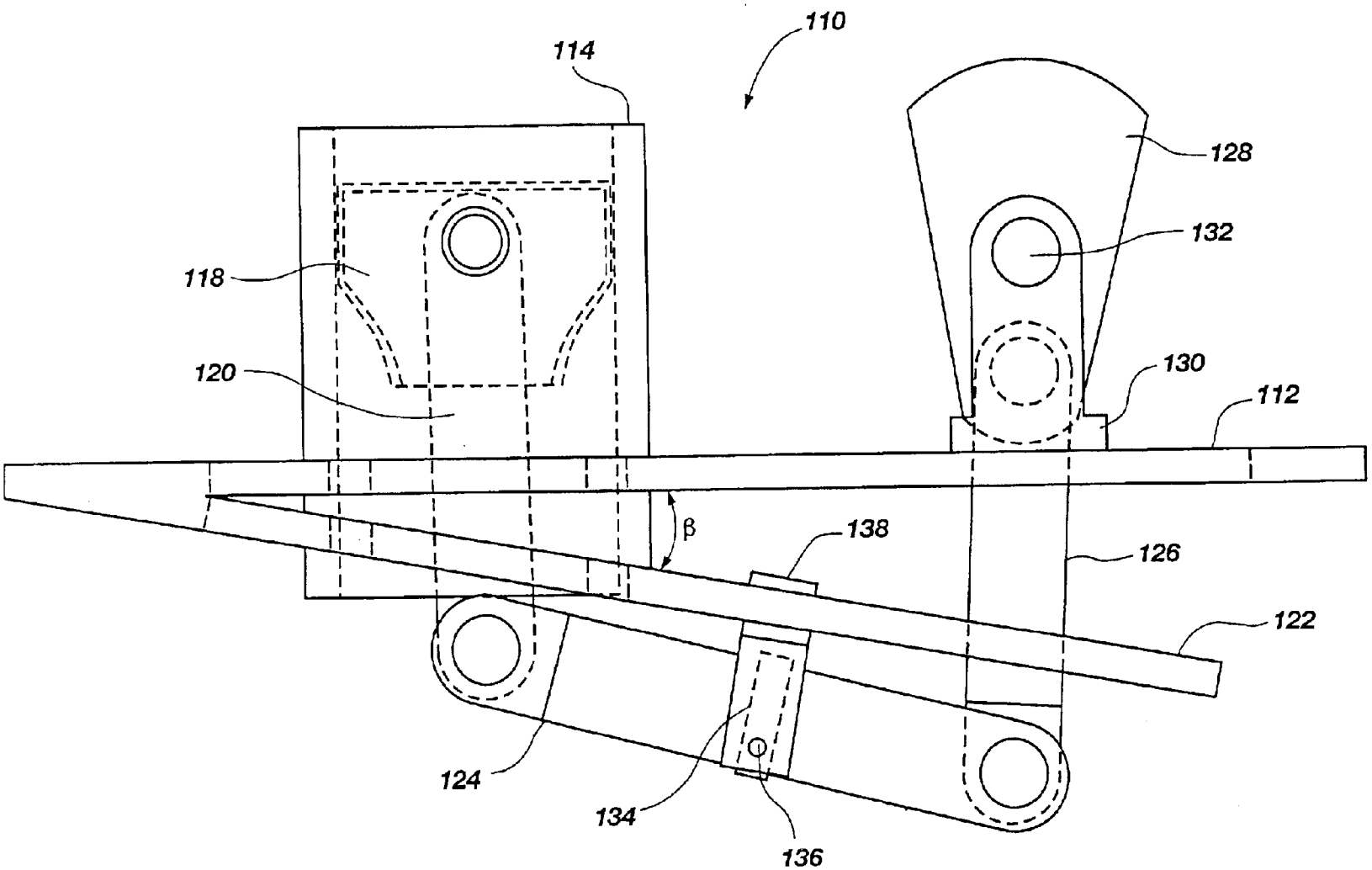
FIG. 8*c* is a break-away side view of the embodiment of FIG. 8, with the piston in a long stroke, top dead center position.
Figure 8D:
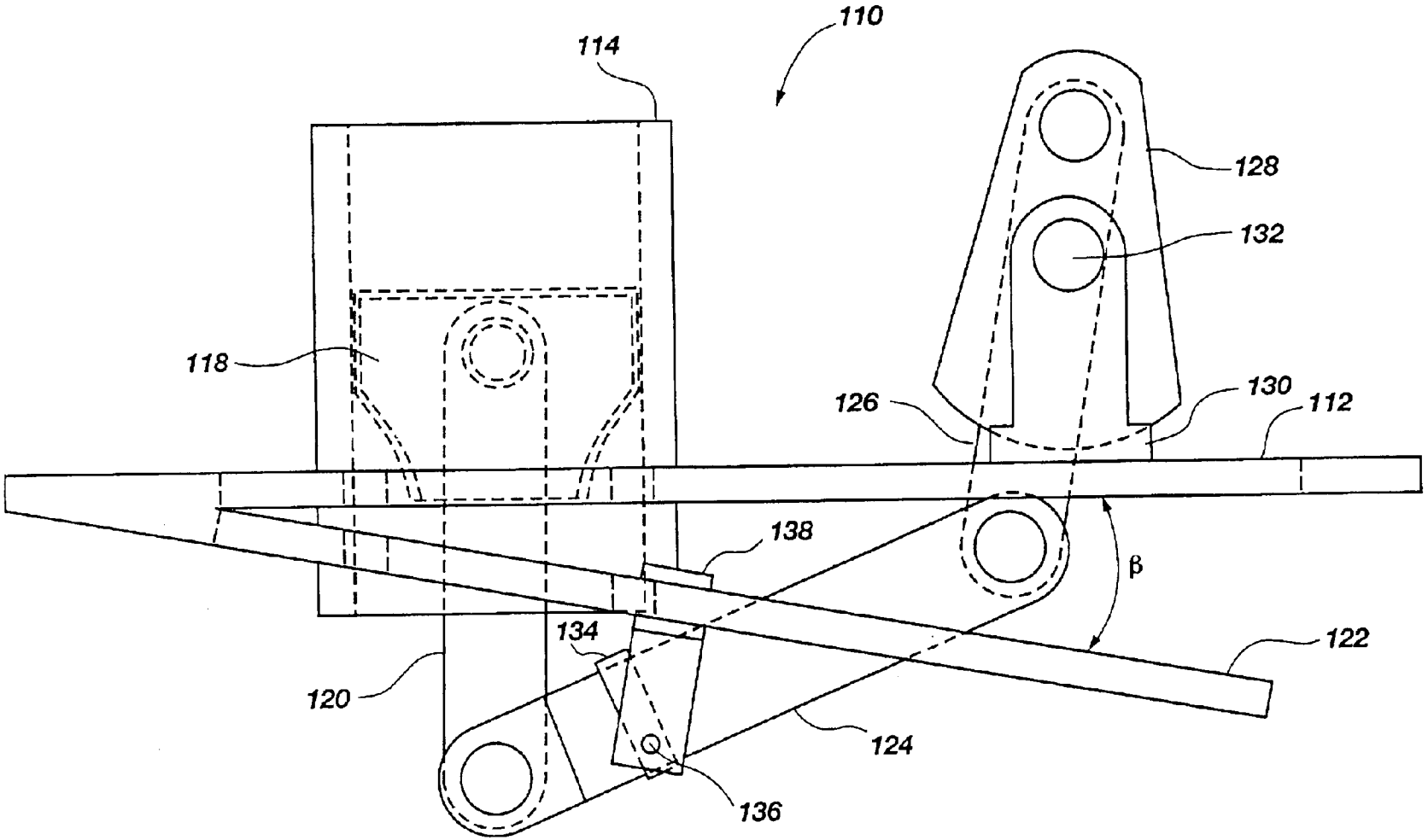
FIG. 8*d* is a break-away side view of the embodiment of FIG. 8, with the piston in a short stroke, bottom dead center position.
Figure 8E:
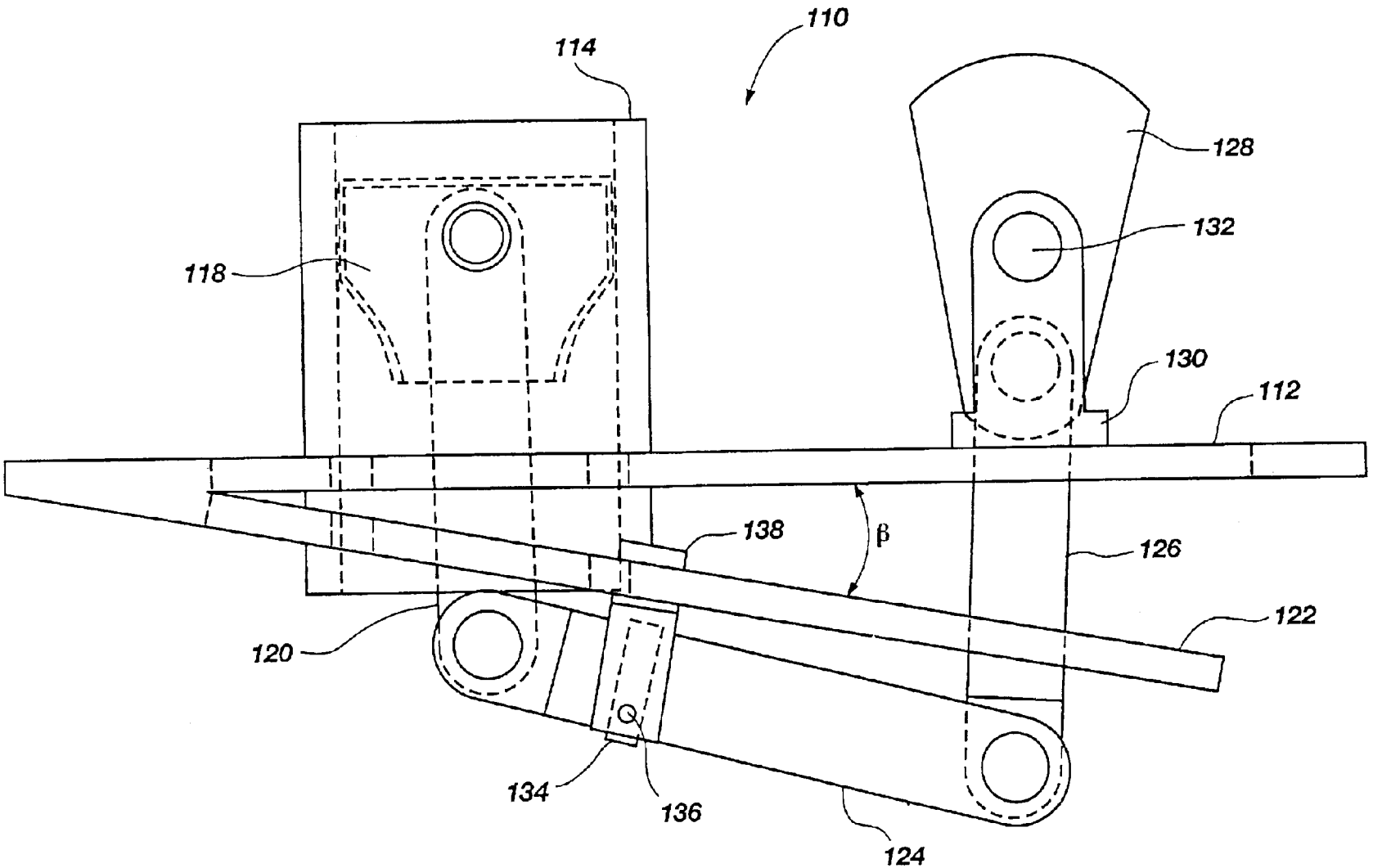
FIG. 8*e* is a break-away side view of the embodiment of FIG. 8, with the piston in a short stroke, top dead center position.

It will be understood that the stroke length of the piston 118 may be adjusted by moving the slider 138 along the length of the angular support 122. As shown in FIG. 8*a*, the piston 118 may be oriented in a long stroke position as the slider 138 is moved along the angular support 122 away from the piston 118. The piston in FIG. 8*a* is in a bottom dead center position. In FIG. 8*b*, the piston 118 is moved upwardly to an intermediate position. FIG. 8*c* shows the piston 118 in a top dead center position. As the slider 138 is moved along the angular support 122 toward the piston 118 as shown in FIG. 8*d*, the stroke length of the piston 118 may be shortened. Comparison of bottom dead center positions of the piston 118 in FIGS. 8*a* and 8*d* demonstrates the ability of the present invention to adjust the stroke length of the piston 118 by moving the slider 134 along the angular support 122.

As shown in the perspective view of FIG. 9, the slider 142 may have a groove 142 for receiving the angled support 122 within the slot 140. However, it will be appreciated that the slider 138 may be attached to the angled support 122 in any manner known in the art to allow the slider 138 to move along the angled support 122. Also, the first link member 124 may have a first pair of flanges 144 for attaching the connecting rod 120 pivotally therebetween, and a second pair of flanges 146 for pivotally attaching the second link member 126 therebetween. It will likewise be understood that other attachment mechanisms known in the art may be used to pivotally attach the connecting rod 120 and the second link member 126 to the first link member 124.

Figure 11:
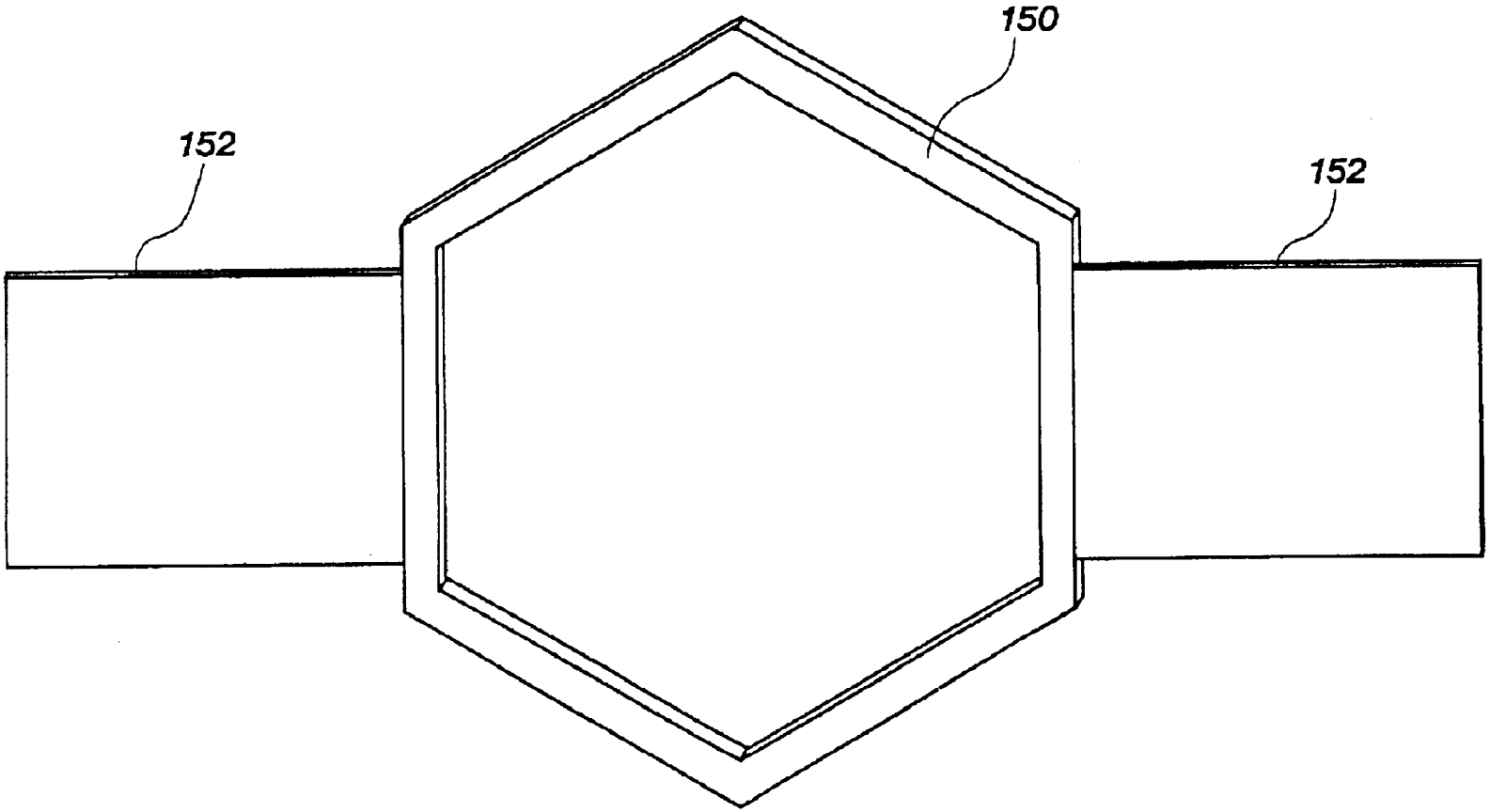
FIG. 11 is an end view of an engine block having opposing cylinders.
Figure 12:
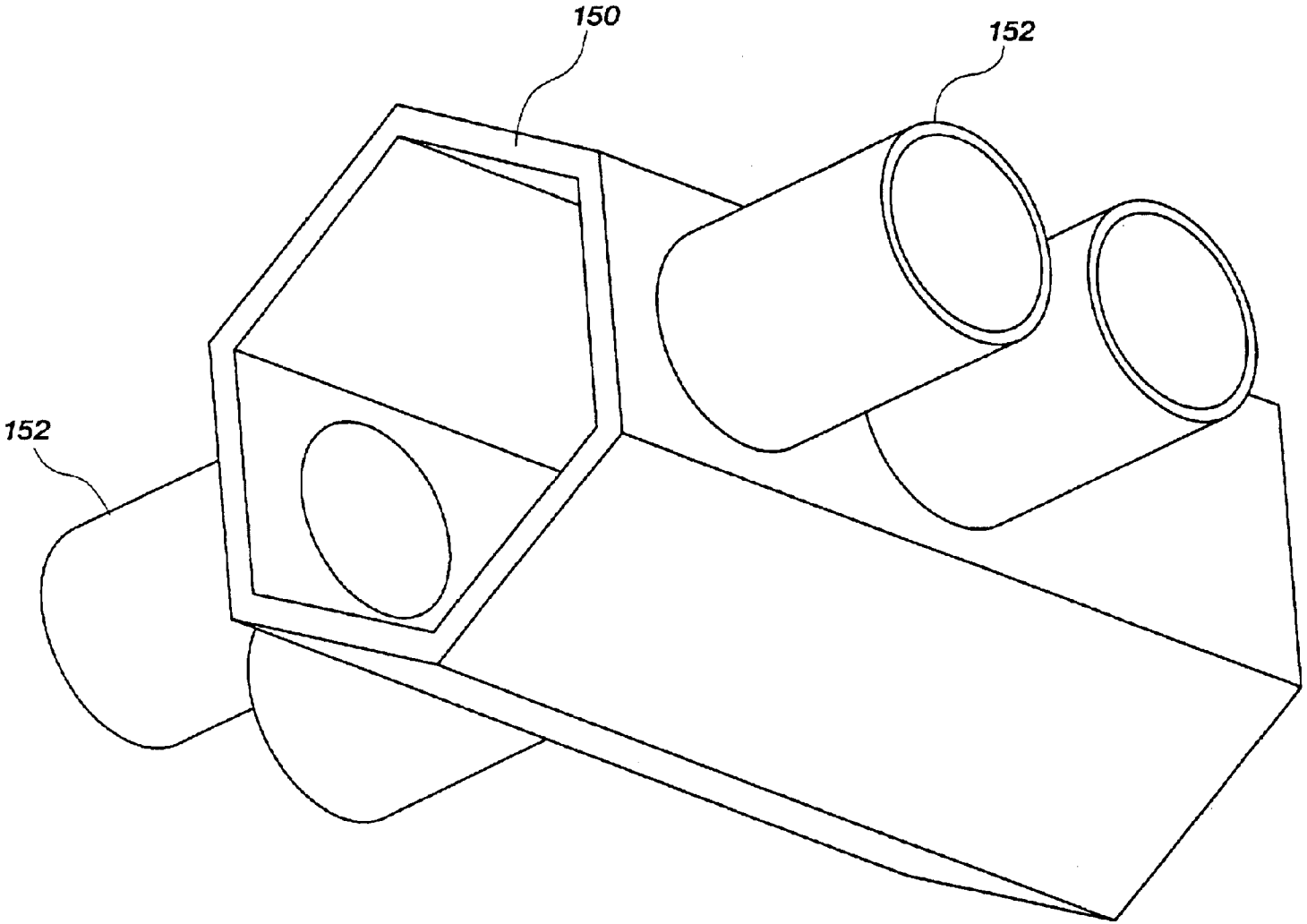
FIG. 12 is a perspective view of an engine block having four cylinders in an opposing orientation.
Figure 13:
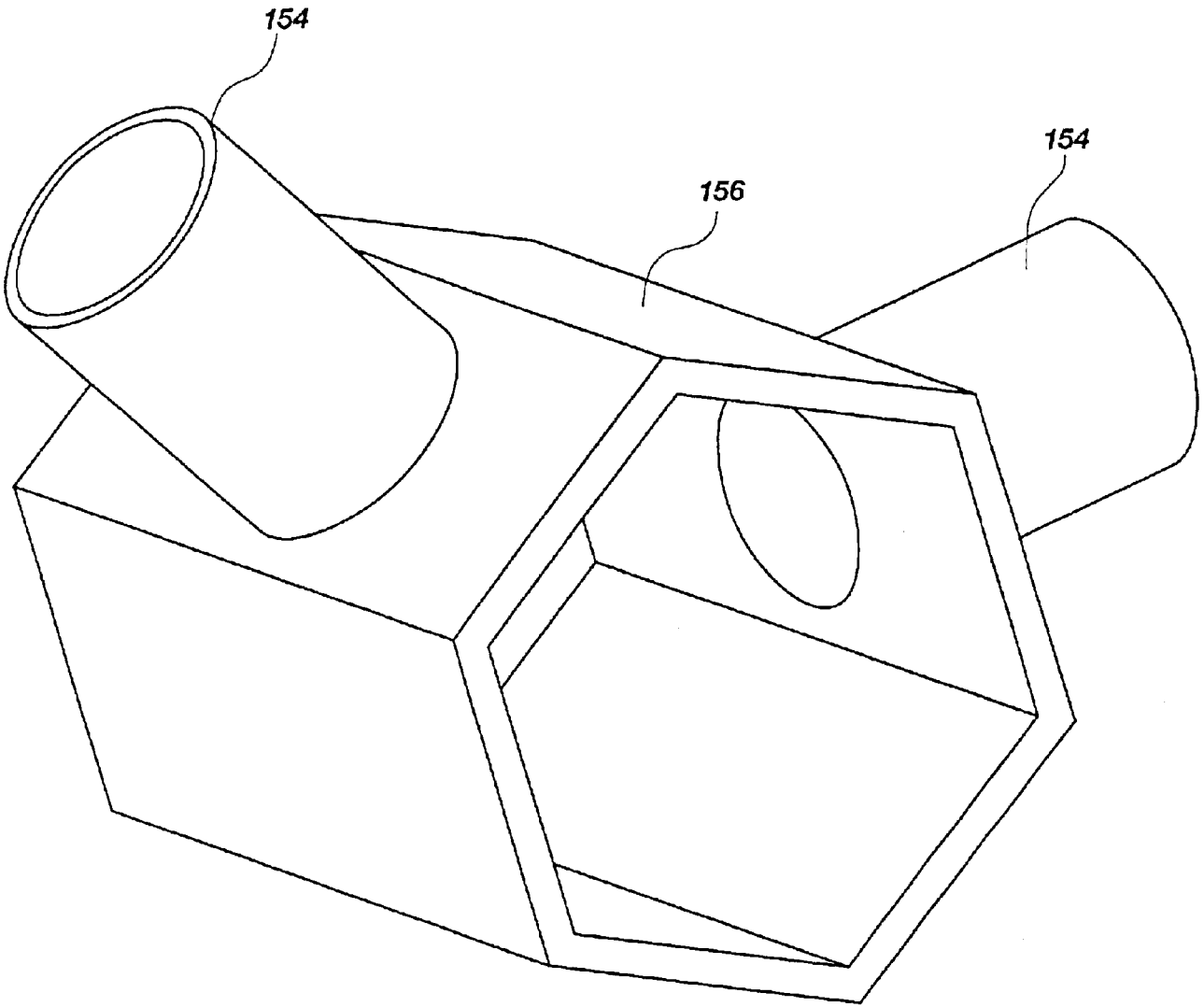
FIG. 13 is a perspective view of an engine block showing two cylinders in a "V" configuration.
Figure 14:
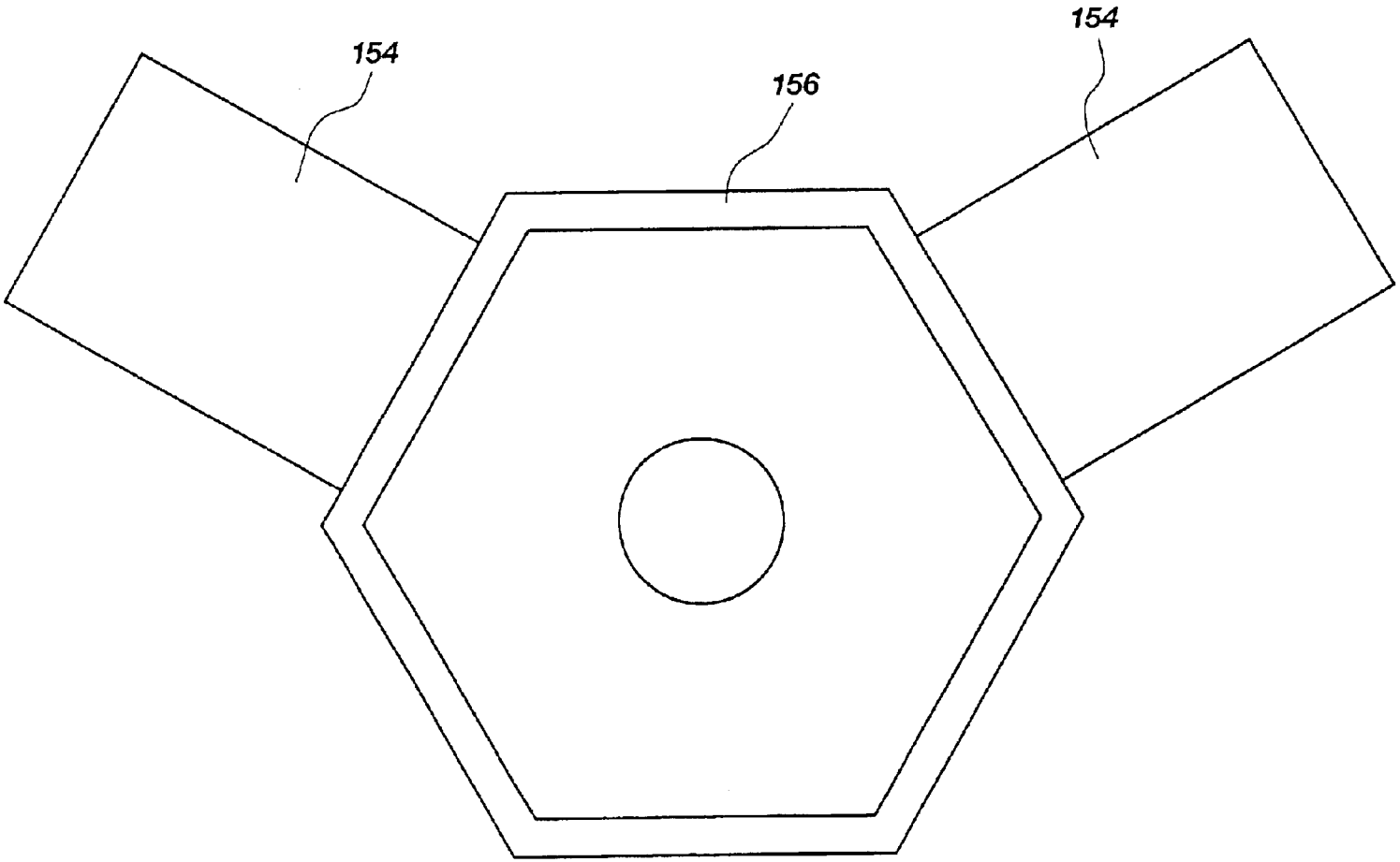
FIG. 14 is an end view of the engine block of FIG. 13.
Figure 15:
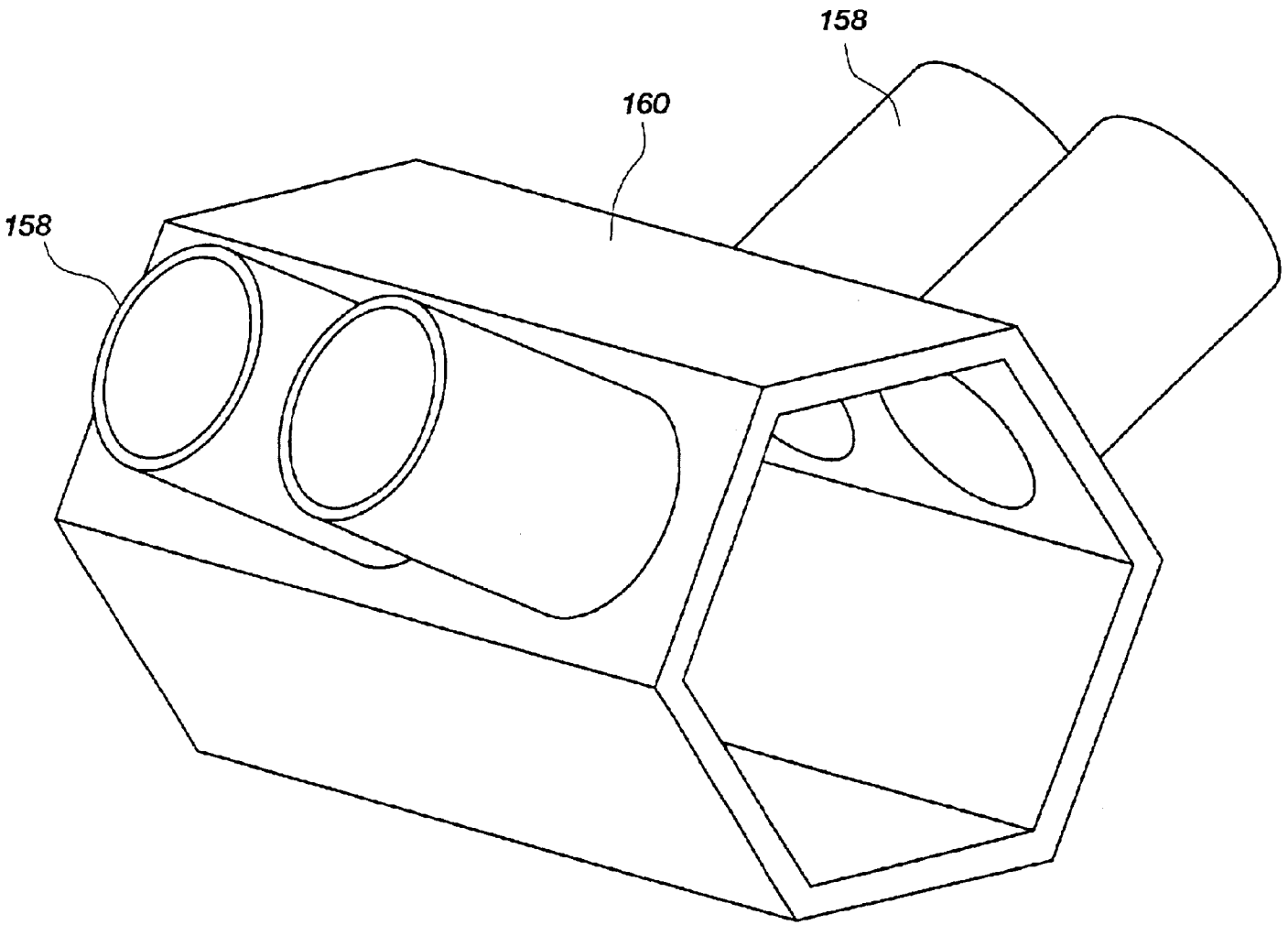
FIG. 15 is a perspective view of an engine block having four cylinders in a "V" configuration.

It will be appreciated that the principles of the present invention, in all embodiments, may be used with engines having various different configurations and using various different numbers of cylinders. For example, as shown in FIG. 11 an engine block 150 may be configured to have a polygonal shape, such as a hexagonal shape for example. However, it will be appreciated that the engine block 150 may have any other shape known in the art within the scope of the present invention. The engine block 150 may also include cylinders 152 opposing each other in a substantially straight line. Any number of cylinders 152 may be used such as two, or four for example as shown in the perspective view of FIG. 12. Likewise, as shown in FIGS. 13–15, the cylinders 154, 158 may be oriented in a substantial "V" shape on an engine block 156, 160 and any number of cylinders 154, 158 may be utilized. The cylinder groupings may also be oriented in a substantially circular pattern or any other arrangement known in the art.

Figure 16A:
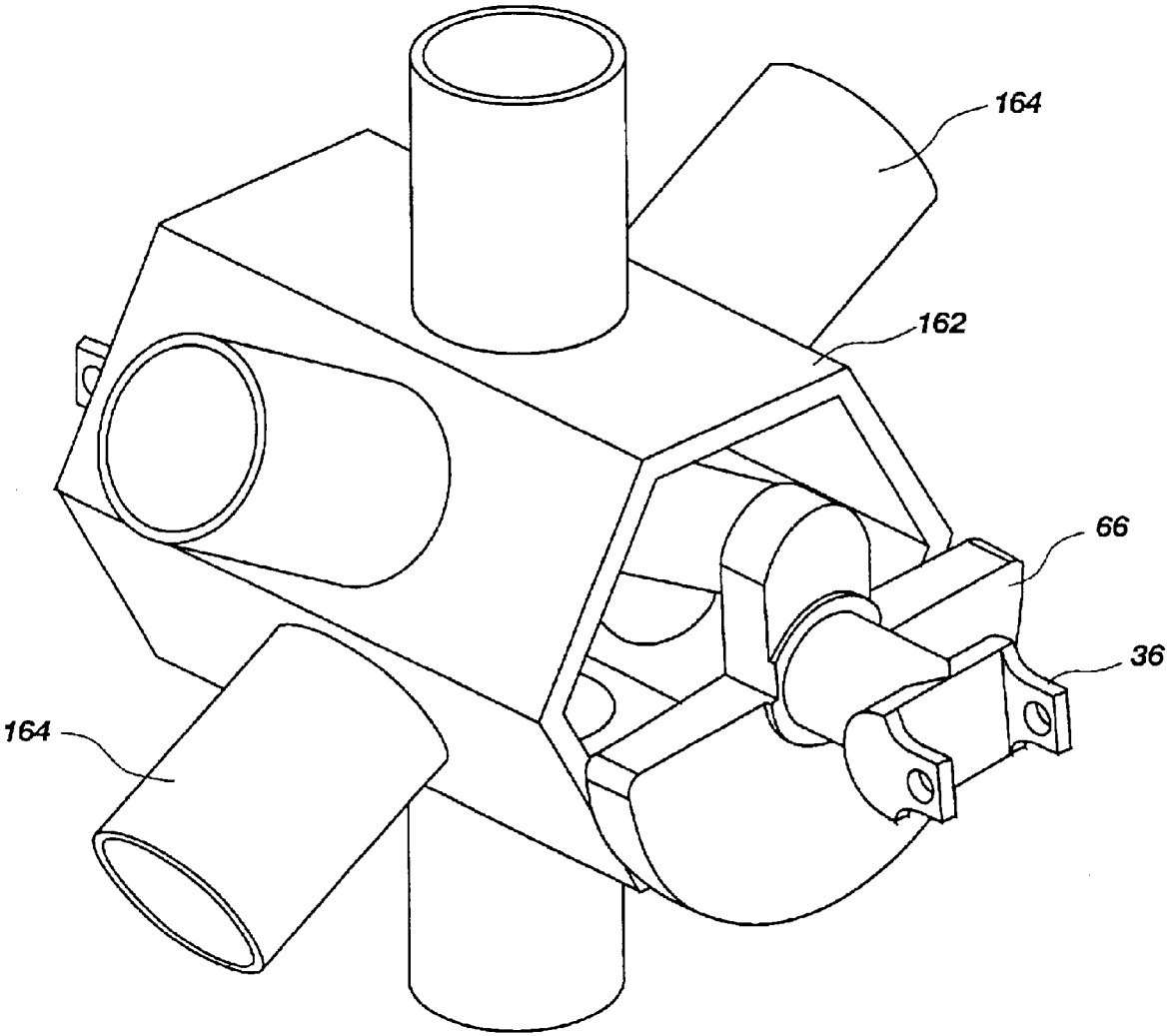
FIG. 16*a* is a perspective view of an engine block having six cylinders in a circular pattern and an angled crankshaft.
Figure 16B:
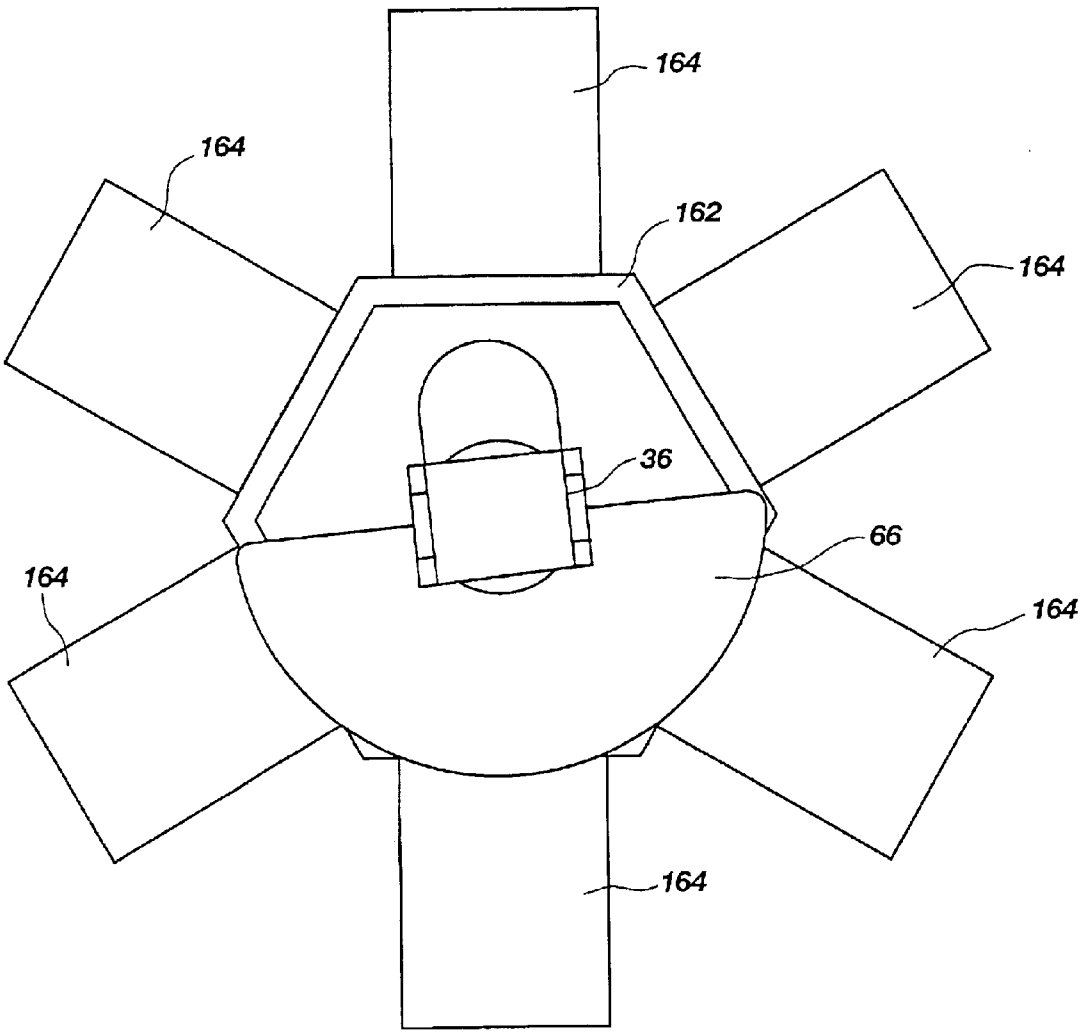
FIG. 16*c* is an end view of the engine block of FIG. 16*a;*
Figure 17:
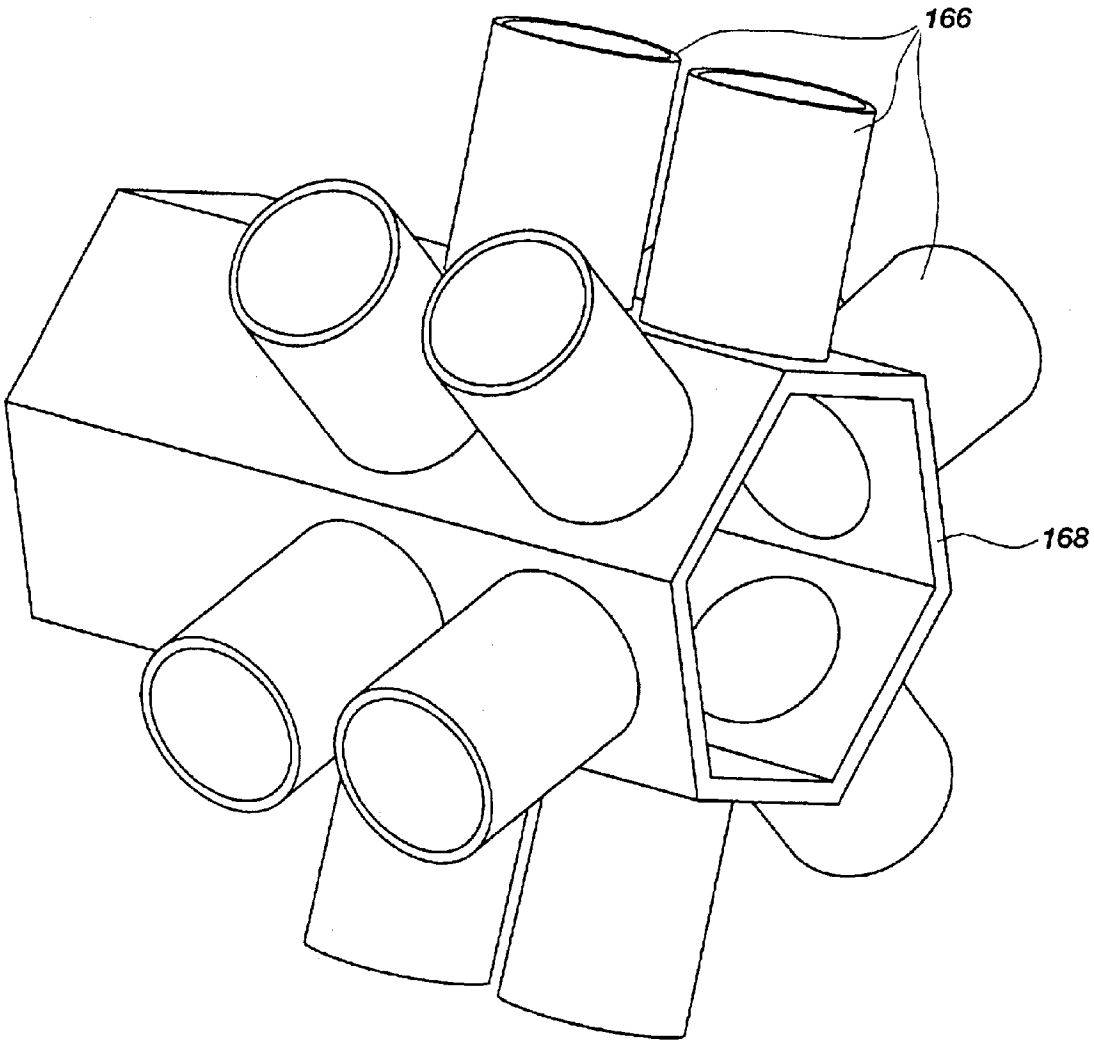
FIG. 17 is a perspective view of an engine block having twelve cylinders in a circular pattern.

Referring now to FIGS. 16*a*–16*c*, an engine block 162 is shown having six cylinders 164 as another possible embodiment of the present invention utilizing the angled segment 38 of the crankshaft 22. Similarly, other numbers of cylinders, such as twelve cylinders 166 may be used on a block 168 as shown in FIG. 17. It will be appreciated that the embodiments of blocks and cylinders depicted in FIGS. 11–17 are only exemplary of the various different combinations of numbers of cylinders and block configurations that may be used, and all different quantities of cylinders and different block configurations are within the scope of the present invention.

It will be appreciated that the structure and apparatus disclosed herein is merely one example of a means for moving the crankshaft, and it should be appreciated that any structure, apparatus or system for moving the crankshaft which performs functions the same as, or equivalent to, those disclosed herein are intended to fall within the scope of a means for moving the crankshaft, including those structures, apparatus or systems for moving the crankshaft which are presently known, or which may become available in the future. Anything which functions the same as, or equivalently to, a means for moving the crankshaft falls within the scope of this element.

It will be appreciated that the structure and apparatus disclosed herein is merely one example of a means for adjusting the position of the slider along the angular support, and it should be appreciated that any structure, apparatus or system for adjusting the position of the slider which performs functions the same as, or equivalent to, those disclosed herein are intended to fall within the scope of a means for adjusting the position of the slider, including those structures, apparatus or systems for adjusting the position of the slider which are presently known, or which may become available in the future. Anything which functions the same as, or equivalently to, a means for adjusting the position of the slider falls within the scope of this element.

In accordance with the features and combinations described above, a useful method of adjusting the stroke length of a piston in an internal combustion engine includes the steps of:

(a) extending a journal portion of a crankshaft along a non-perpendicular angle with respect to an axis of movement of the piston; and (b) moving the crankshaft in a longitudinal direction with respect to the piston.

Those having ordinary skill in the relevant art will appreciate the advantages provide by the features of the present invention. For example, it is a feature of the present invention to provide an internal combustion engine that is simple in design and manufacture. Another feature of the present invention is to provide such an engine that has an adjustable stroke length to enhance working efficiency, power and torque capabilities of the engine. It is a further feature of the present invention, in accordance with one aspect thereof, to provide a stroke adjustment mechanism that can be used with engines having different strokes and using different varieties of fuel such as gasoline, kerosene, diesel, propane, oil, or natural gas. Moreover, the adjustable stroke length characteristic of the present invention allows the engine to operate at optimal efficiency, power, and torque under various conditions of temperature, atmospheric pressure or load conditions.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. An engine comprising:

a piston movable through a stroke length along a movement axis;

a connecting rod attached to said piston;

a rotational crankshaft having a journal portion attached to said connecting rod, said crankshaft extending in a longitudinal direction;

wherein said journal portion of said crankshaft extends in a direction that is non-perpendicular with respect to said movement axis of said piston such that when said crankshaft is moved in said longitudinal direction, said stroke length of said piston is adjusted;

wherein said crankshaft further comprises multiple segments including a first end portion and an angled segment disposed at a non-zero angle with respect to said first end portion, wherein said crankshaft further comprises a universal connection intercoupling said angled segment and said first end portion.

2. The engine of claim 1, wherein a bearing is disposed between said connecting rod and said journal portion.

3. The engine of claim 2, wherein said bearing has a substantially spherical configuration.

4. The engine of claim 2, wherein said bearing has an opening for receiving said journal portion therethrough.

5. The engine of claim 1, further comprising an engine block for receiving said piston.

6. The engine of claim 1, further comprising a cylinder for receiving said piston.

7. The engine of claim 6, further comprising a head for covering said cylinder.

8. The engine of claim 1, wherein said first end portion has a first axis of rotation.

9. The engine of claim 1, further comprising a first side support for supporting said first end portion.

10. The engine of claim 8, wherein said crankshaft further comprises a second end portion.

11. The engine of claim 10, wherein said second end portion has a second axis of rotation.

12. The engine of claim 10, further comprising a second side support for supporting said second end portion.

13. The engine of claim 11, wherein said first axis of rotation is parallel to said second axis of rotation.

14. The engine of claim 11, wherein said first axis of rotation is coaxial with said second axis of rotation.

15. The engine of claim 11, wherein said journal portion of said crankshaft is disposed on said angled segment.

16. The engine of claim 15, wherein said angled segment has an angled segment axis of rotation.

17. The engine of claim 16, wherein said angled segment axis of rotation is non parallel with said first axis of rotation and said second axis of rotation.

18. The engine of claim 15, wherein said angled segment comprises an angled segment first end and an angled segment second end.

19. The engine of claim 18, wherein said angled segment first end comprises a counterweight.

20. The engine of claim 19, wherein said counterweight comprises a segmented disc shape.

21. The engine of claim 18, wherein said angled segment second end comprises a collar.

22. The engine of claim 15, wherein said second end portion is attached to said angled segment through a universal connection.

23. The engine of claim 15, wherein said universal connection comprises a first span fixedly attached to the first end portion.

24. The engine of claim 23, wherein said first span comprises spaced apart walls.

25. The engine of claim 24, further comprising a pivot supported by said spaced apart walls.

26. The engine of claim 25, wherein said pivot comprises two intersecting rods.

27. The engine of claim 26, wherein a first end of said angled segment comprises a second span.

28. The engine of claim 27, wherein said second span comprises complementary spaced apart walls.

29. The engine of claim 28, wherein one of said rods is pivotally attached to said first span and another of said rods is pivotally attached to said second span.

30. The engine of claim 1, further comprising a second piston disposed on said journal portion.

31. The engine of claim 15, wherein said angled segment comprises a plurality of counterweights.

32. The engine of claim 15, wherein said angled segment comprises a first counterweight disposed on a first end of said angled segment, and a second counterweight disposed on a second end of said angled segment.

33. The engine of claim 1, wherein said journal portion of said crankshaft is disposed on said angled segment, and wherein said angled segment comprises a second journal portion.

34. The engine of claim 33, wherein said second journal portion extends in a direction that is non-parallel with said journal portion.

35. The engine of claim 33, wherein said engine further comprises a second piston.

36. The engine of claim 35, wherein said engine further comprises a third piston and a fourth piston.

37. The engine of claim 36, wherein said third piston and said fourth piston are supported on said second journal portion.

38. The engine of claim 1, further comprising an engine block having a polygonal shape.

39. The engine of claim 38, wherein said polygonal shape is hexagonal.

40. The engine of claim 1, further comprising a second piston configured in an opposing orientation with said piston.

41. The engine of claim 1, wherein said engine comprises a block having four cylinders configured such that two of said cylinders are positioned on one side of said block and the other two of said cylinders are positioned on an opposite side of said block.

42. The engine of claim 1, further comprising a plurality of cylinders oriented on an engine block so as to form a substantial "V" configuration.

43. The engine of claim 42, wherein said plurality of cylinders comprises two cylinders.

44. The engine of claim 42, wherein said plurality of cylinders comprises four cylinders.

45. The engine of claim 1, further comprising a plurality of cylinders.

46. The engine of claim 45, wherein said plurality of cylinders comprises two cylinders.

47. The engine of claim 45, wherein said plurality of cylinders comprises four cylinders.

48. The engine of claim 45, wherein said plurality of cylinders comprises six cylinders.

49. The engine of claim 45, wherein said plurality of cylinders comprises eight cylinders.

50. The engine of claim 45, wherein said plurality of cylinders comprises ten cylinders.

51. The engine of claim 45, wherein said plurality of cylinders comprises twelve cylinders.

52. The engine of claim 1, wherein said journal portion of said crankshaft is disposed on said angled segment, said angled segment having an axis of rotation, and wherein said journal portion extends at an angle $\alpha$ with respect to said axis of rotation.

53. The engine of claim 52, wherein said angle $\alpha$ is within a range of between approximately 0 degrees and approximately 90 degrees.

54. An engine comprising:

a piston movable through a stroke length along a movement axis;

a connecting rod attached to said piston;

a rotational crankshaft having a journal portion attached to said connecting rod, said crankshaft extending in a longitudinal direction;

wherein said journal portion of said crankshaft extends in a direction that is non-perpendicular with respect to said movement axis of said piston such that when said crankshaft is moved in said longitudinal direction, said stroke length of said piston is adjusted;

wherein said journal portion of said crankshaft is disposed on an angled segment, said angled segment having an axis of rotation, and wherein said journal portion extends at an angle $\alpha$ with respect to said axis of rotation;

wherein said angle $\alpha$ is within a range of between approximately 0 degrees and approximately 90 degrees; and wherein said angle $\alpha$ is within a range of between approximately 5 degrees and approximately 20 degrees.

55. The engine of claim 54, wherein said angle $\alpha$ is approximately 12 degrees.

56. An engine comprising:

a piston movable through a stroke length along a movement axis;

a connecting rod attached to said piston;

a rotational crankshaft having a journal portion attached to said connecting rod, said crankshaft extending in a longitudinal direction;

wherein said journal portion of said crankshaft extends in a direction that is non-perpendicular with respect to said movement axis of said piston such that when said crankshaft is moved in said longitudinal direction, said stroke length of said piston is adjusted;

wherein said journal portion of said crankshaft is disposed on an angled segment, said angled segment having an axis of rotation, and wherein said journal portion extends at an angle $\alpha$ with respect to said axis of rotation; and wherein said angle $\alpha$ is within a range of between approximately 0 degrees and approximately 10 degrees.

57. The engine of claim 56, wherein said angle $\alpha$ is approximately 5 degrees.

58. An engine comprising:

a piston movable through a stroke length along a movement axis;

a connecting rod attached to said piston;

a rotational crankshaft having a journal portion attached to said connecting rod, said crankshaft extending in a longitudinal direction;

wherein said journal portion of said crankshaft extends in a direction that is non-perpendicular with respect to said movement axis of said piston such that when said crankshaft is moved in said longitudinal direction, said stroke length of said piston is adjusted;

wherein said journal portion of said crankshaft is disposed on an angled segment, said angled segment having an axis of rotation, and wherein said journal portion extends at an angle $\alpha$ with respect to said axis of rotation; and wherein said angle $\alpha$ is within a range of between approximately 10 degrees and approximately 20 degrees.

59. The engine of claim 58, wherein said angle $\alpha$ is approximately 15 degrees.

60. An engine comprising:

a piston movable through a stroke length along a movement axis;

a connecting rod attached to said piston;

a rotational crankshaft having a journal portion attached to said connecting rod, said crankshaft extending in a longitudinal direction;

wherein said journal portion of said crankshaft extends in a direction that is non-perpendicular with respect to said movement axis of said piston such that when said crankshaft is moved in said longitudinal direction, said stroke length of said piston is adjusted;

wherein said journal portion of said crankshaft is disposed on an angled segment, said angled segment having an axis of rotation, and wherein said journal portion extends at an angle $\alpha$ with respect to said axis of rotation; and wherein said angle $\alpha$ is within a range of between approximately 20 degrees and approximately 30 degrees.

61. The engine of claim 60, wherein said angle $\alpha$ is approximately 25 degrees.

62. An engine comprising:

a piston movable through a stroke length along a movement axis;

a connecting rod attached to said piston;

a rotational crankshaft having a journal portion attached to said connecting rod, said crankshaft extending in a longitudinal direction;

wherein said journal portion of said crankshaft extends in a direction that is non-perpendicular with respect to said movement axis of said piston such that when said crankshaft is moved in said longitudinal direction, said stroke length of said piston is adjusted;

wherein said journal portion of said crankshaft is disposed on an angled segment, said angled segment having an axis of rotation, and wherein said journal portion extends at an angle $\alpha$ with respect to said axis of rotation; and wherein said angle $\alpha$ is within a range of between approximately 30 degrees and approximately 40 degrees.

63. The engine of claim 62, wherein said angle $\alpha$ is approximately 35 degrees.

64. An engine comprising:

a piston movable through a stroke length along a movement axis;

a connecting rod attached to said piston;

a rotational crankshaft having a journal portion attached to said connecting rod, said crankshaft extending in a longitudinal direction;

wherein said journal portion of said crankshaft extends in a direction that is non-perpendicular with respect to said movement axis of said piston such that when said crankshaft is moved in said longitudinal direction, said stroke length of said piston is adjusted;

wherein said journal portion of said crankshaft is disposed on an angled segment, said angled segment having an axis of rotation, and wherein said journal portion extends at an angle $\alpha$ with respect to said axis of rotation; and wherein said angle $\alpha$ is within a range of between approximately 40 degrees and approximately 50 degrees.

65. The engine of claim 64, wherein said angle $\alpha$ is approximately 45 degrees.

66. An engine comprising:

a piston movable through a stroke length along a movement axis;

a connecting rod attached to said piston;

a rotational crankshaft having a journal portion attached to said connecting rod, said crankshaft extending in a longitudinal direction;

wherein said journal portion of said crankshaft extends in a direction that is non-perpendicular with respect to said movement axis of said piston such that when said crankshaft is moved in said longitudinal direction, said stroke length of said piston is adjusted;

wherein said journal portion of said crankshaft is disposed on an angled segment, said angled segment having an axis of rotation, and wherein said journal portion extends at an angle $\alpha$ with respect to said axis of rotation; and wherein said angle $\alpha$ is within a range of between approximately 50 degrees and approximately 60 degrees.

67. The engine of claim 66, wherein said angle $\alpha$ is approximately 55 degrees.

68. An engine comprising:

a piston movable through a stroke length along a movement axis;

a connecting rod attached to said piston;

a rotational crankshaft having a journal portion attached to said connecting rod, said crankshaft extending in a longitudinal direction;

wherein said journal portion of said crankshaft extends in a direction that is non-perpendicular with respect to said movement axis of said piston such that when said crankshaft is moved in said longitudinal direction, said stroke length of said piston is adjusted;

wherein said journal portion of said crankshaft is disposed on an angled segment, said angled segment having an axis of rotation, and wherein said journal portion extends at an angle $\alpha$ with respect to said axis of rotation; and wherein said angle $\alpha$ is within a range of between approximately 60 degrees and approximately 70 degrees.

69. The engine of claim 68, wherein said angle $\alpha$ is approximately 65 degrees.

70. An engine comprising:

a piston movable through a stroke length along a movement axis;

a connecting rod attached to said piston;

a rotational crankshaft having a journal portion attached to said connecting rod, said crankshaft extending in a longitudinal direction;

wherein said journal portion of said crankshaft extends in a direction that is non-perpendicular with respect to said movement axis of said piston such that when said crankshaft is moved in said longitudinal direction, said stroke length of said piston is adjusted;

wherein said journal portion of said crankshaft is disposed on an angled segment, said angled segment having an axis of rotation, and wherein said journal portion extends at an angle $\alpha$ with respect to said axis of rotation; and wherein said angle $\alpha$ is within a range of between approximately 70 degrees and approximately 80 degrees.

71. The engine of claim 70, wherein said angle $\alpha$ is approximately 75 degrees.

72. The engine of claim 52, wherein said angle $\alpha$ is within a range of between approximately 80 degrees and approximately 90 degrees.

73. The engine of claim 72, wherein said angle $\alpha$ is approximately 85 degrees.

74. The engine of claim 1, wherein said piston has a round cross-sectional shape.

75. The engine of claim 1, wherein said piston has an oval cross-sectional shape.

76. An engine comprising:

a piston movable through a stroke length along a movement axis;

a connecting rod attached to said piston;

a rotational crankshaft having a journal portion attached to said connecting rod, said crankshaft extending in a longitudinal direction;

wherein said journal portion of said crankshaft extends in a direction that is non-perpendicular with respect to said movement axis of said piston such that when said crankshaft is moved in said longitudinal direction, said stroke length of said piston is adjusted;

further comprising a second piston disposed on said journal portion;

wherein said journal portion is configured to be movable with respect to said second piston such that said second piston can be adjusted to be turned off and have substantially no stroke length.

77. The engine of claim 1, wherein said journal portion of said crankshaft is disposed on said angled segment, said angled segment having an axis of rotation, and wherein said axis of rotation extends at an angle $\theta$ with respect to a line that is perpendicular with respect to said movement axis.

78. The engine of claim 77, wherein said angle $\theta$ is within a range of between approximately 0 degrees and approximately 90 degrees.

79. An engine comprising:

a piston movable through a stroke length along a movement axis;

a connecting rod attached to said piston;

a rotational crankshaft having a journal portion attached to said connecting rod, said crankshaft extending in a longitudinal direction;

wherein said journal portion of said crankshaft extends in a direction that is non-perpendicular with respect to said movement axis of said piston such that when said crankshaft is moved in said longitudinal direction, said stroke length of said piston is adjusted;

wherein said journal portion of said crankshaft is disposed on an angled segment, said angled segment having an axis of rotation, and wherein said axis of rotation extends at an angle $\theta$ with respect to a line that is perpendicular with respect to said movement axis;

wherein said angle $\theta$ is within a range of between approximately 0 degrees and approximately 90 degrees; and wherein said angle $\theta$ is within a range of between approximately 5 degrees and approximately 25 degrees.

80. The engine of claim 79, wherein said angle $\theta$ is approximately 15 degrees.

81. The engine of claim 77 wherein said angle $\theta$ is within a range of between approximately 0 degrees and approximately 10 degrees.

82. An engine comprising:

a piston movable through a stroke length along a movement axis;

a connecting rod attached to said piston;

a rotational crankshaft having a journal portion attached to said connecting rod, said crankshaft extending in a longitudinal direction;

wherein said journal portion of said crankshaft extends in a direction that is non-perpendicular with respect to said movement axis of said piston such that when said crankshaft is moved in said longitudinal direction, said stroke length of said piston is adjusted;

wherein said journal portion of said crankshaft is disposed on an angled segment, said angled segment having an axis of rotation, and wherein said axis of rotation extends at an angle $\theta$ with respect to a line that is perpendicular with respect to said movement axis;

wherein said angle $\theta$ is within a range of between approximately 0 degrees and approximately 10 degrees;

wherein said angle $\theta$ is approximately 5 degrees.

83. An engine comprising:

a piston movable through a stroke length along a movement axis;

a connecting rod attached to said piston;

a rotational crankshaft having a journal portion attached to said connecting rod, said crankshaft extending in a longitudinal direction;

wherein said journal portion of said crankshaft extends in a direction that is non-perpendicular with respect to said movement axis of said piston such that when said crankshaft is moved in said longitudinal direction, said stroke length of said piston is adjusted;

wherein said journal portion of said crankshaft is disposed on an angled segment, said angled segment having an axis of rotation, and wherein said axis of rotation extends at an angle $\theta$ with respect to a line that is perpendicular with respect to said movement axis;

wherein said angle $\theta$ is within a range of between approximately 10 degrees and approximately 20 degrees.

84. The engine of claim 83, wherein said angle $\theta$ is approximately 15 degrees.

85. An engine comprising:

a piston movable through a stroke length along a movement axis;

a connecting rod attached to said piston;

a rotational crankshaft having a journal portion attached to said connecting rod, said crankshaft extending in a longitudinal direction;

wherein said journal portion of said crankshaft extends in a direction that is non-perpendicular with respect to said movement axis of said piston such that when said crankshaft is moved in said longitudinal direction, said stroke length of said piston is adjusted;

wherein said journal portion of said crankshaft is disposed on an angled segment, said angled segment having an axis of rotation, and wherein said axis of rotation extends at an angle θ with respect to a line that is perpendicular with respect to said movement axis;

wherein said angle θ is within a range of between approximately 20 degrees and approximately 30 degrees.

86. The engine of claim 85, wherein said angle θ is approximately 25 degrees.

87. An engine comprising:

a piston movable through a stroke length along a movement axis;

a connecting rod attached to said piston;

a rotational crankshaft having a journal portion attached to said connecting rod, said crankshaft extending in a longitudinal direction;

wherein said journal portion of said crankshaft extends in a direction that is non-perpendicular with respect to said movement axis of said piston such that when said crankshaft is moved in said longitudinal direction, said stroke length of said piston is adjusted;

wherein said journal portion of said crankshaft is disposed on an angled segment, said angled segment having an axis of rotation, and wherein said axis of rotation extends at an angle θ with respect to a line that is perpendicular with respect to said movement axis;

wherein said angle θ is within a range of between approximately 30 degrees and approximately 40 degrees.

88. The engine of claim 87, wherein said angle θ is approximately 35 degrees.

89. An engine comprising:

a piston movable through a stroke length along a movement axis;

a connecting rod attached to said piston;

a rotational crankshaft having a journal portion attached to said connecting rod, said crankshaft extending in a longitudinal direction;

wherein said journal portion of said crankshaft extends in a direction that is non-perpendicular with respect to said movement axis of said piston such that when said crankshaft is moved in said longitudinal direction, said stroke length of said piston is adjusted;

wherein said journal portion of said crankshaft is disposed on an angled segment, said angled segment having an axis of rotation, and wherein said axis of rotation extends at an angle θ with respect to a line that is perpendicular with respect to said movement axis;

wherein said angle θ is within a range of between approximately 40 degrees and approximately 50 degrees.

90. The engine of claim 89, wherein said angle θ is approximately 45 degrees.

91. An engine comprising:

a piston movable through a stroke length along a movement axis;

a connecting rod attached to said piston;

a rotational crankshaft having a journal portion attached to said connecting rod, said crankshaft extending in a longitudinal direction;

wherein said journal portion of said crankshaft extends in a direction that is non-perpendicular with respect to said movement axis of said piston such that when said crankshaft is moved in said longitudinal direction, said stroke length of said piston is adjusted;

wherein said journal portion of said crankshaft is disposed on an angled segment, said angled segment having an axis of rotation, and wherein said axis of rotation extends at an angle θ with respect to a line that is perpendicular with respect to said movement axis;

wherein said angle θ is within a range of between approximately 50 degrees and approximately 60 degrees.

92. The engine of claim 91, wherein said angle θ is approximately 55 degrees.

93. An engine comprising:

a piston movable through a stroke length along a movement axis;

a connecting rod attached to said piston;

a rotational crankshaft having a journal portion attached to said connecting rod, said crankshaft extending in a longitudinal direction;

wherein said journal portion of said crankshaft extends in a direction that is non-perpendicular with respect to said movement axis of said piston such that when said crankshaft is moved in said longitudinal direction, said stroke length of said piston is adjusted;

wherein said journal portion of said crankshaft is disposed on an angled segment, said angled segment having an axis of rotation, and wherein said axis of rotation extends at an angle θ with respect to a line that is perpendicular with respect to said movement axis;

wherein said angle θ is within a range of between approximately 60 degrees and approximately 70 degrees.

94. The engine of claim 93, wherein said angle θ is approximately 65 degrees.

95. An engine comprising:

a piston movable through a stroke length along a movement axis;

a connecting rod attached to said piston;

a rotational crankshaft having a journal portion attached to said connecting rod, said crankshaft extending in a longitudinal direction;

wherein said journal portion of said crankshaft extends in a direction that is non-perpendicular with respect to said movement axis of said piston such that when said crankshaft is moved in said longitudinal direction, said stroke length of said piston is adjusted;

wherein said journal portion of said crankshaft is disposed on an angled segment, said angled segment having an axis of rotation, and wherein said axis of rotation extends at an angle θ with respect to a line that is perpendicular with respect to said movement axis;

wherein said angle θ is within a range of between approximately 70 degrees and approximately 80 degrees.

96. The engine of claim 95, wherein said angle θ is approximately 75 degrees.

97. The engine of claim 77, wherein said angle θ is within a range of between approximately 80 degrees and approximately 90 degrees.

98. An engine comprising:

a piston movable through a stroke length along a movement axis;

a connecting rod attached to said piston;

a rotational crankshaft having a journal portion attached to said connecting rod, said crankshaft extending in a longitudinal direction;

wherein said journal portion of said crankshaft extends in a direction that is non-perpendicular with respect to said movement axis of said piston such that when said crankshaft is moved in said longitudinal direction, said stroke length of said piston is adjusted;

wherein said journal portion of said crankshaft is disposed on an angled segment, said angled segment having an axis of rotation, and wherein said axis of rotation extends at an angle θ with respect to a line that is perpendicular with respect to said movement axis;

wherein said angle θ is within a range of between approximately 80 degrees and approximately 90 degrees;

wherein said angle θ is approximately 85 degrees.

99. The engine of claim 1, wherein said journal portion has a round cross-sectional shape.

100. The engine of claim 1, wherein said journal portion has an oblong cross-sectional shape.

101. The engine of claim 1, wherein said journal portion has a triangular cross-sectional shape.

102. The engine of claim 1, wherein said journal portion has a square cross-sectional shape.

103. The engine of claim 1, wherein said journal portion has a rectangular cross-sectional shape.

104. The engine of claim 1, wherein said journal portion has an "I" shaped cross-section.

105. The engine of claim 1, wherein said journal portion comprises a curved configuration along a length of said journal portion.

106. The engine of claim 1, further comprising at least one additional piston disposed on said journal portion.

107. The engine of claim 1, further comprising means for moving said crankshaft in said longitudinal direction with respect to said piston.

108. The engine of claim 1, wherein said journal portion of said crankshaft is disposed at a non-zero angle beneath and with respect to a line that is perpendicular with the movement axis of the piston, when said piston resides in a top dead center position.

109. An engine comprising:

a piston movable through a stroke length along a movement axis;

a connecting rod attached to said piston;

a rotational crankshaft having a journal portion attached to said connecting rod, said crankshaft extending in a longitudinal direction;

wherein said journal portion of said crankshaft extends in a direction that is non-perpendicular with respect to said movement axis of said piston such that when said crankshaft is moved in said longitudinal direction, said stroke length of said piston is adjusted;

wherein a top dead center position of the piston is identical for multiple stroke length positions of said piston when said stroke length is adjusted by movement of said crankshaft in said longitudinal direction.

110. An engine comprising:

a piston;

a connecting rod attached to said piston; and a rotational crankshaft attached to said connecting rod, said crankshaft comprising a first end portion having a first axis of rotation and an angled segment having an angled segment axis of rotation;

wherein said first axis of rotation and said angled segment axis of rotation are non-parallel;

wherein said crankshaft further comprises a universal connection intercoupling said angled segment and said first end portion.

111. The engine of claim 110, wherein said angled segment further comprises a journal portion, and wherein said journal portion extends at an angle with respect to said angled segment axis of rotation.

112. The engine of claim 110, wherein said piston is movable through a stroke length along a movement axis, and wherein said angled segment axis of rotation extends at an angle θ with respect to a line that is perpendicular with respect to said movement axis.

113. The engine of claim 110, wherein said engine further comprises a means for moving said crankshaft in a longitudinal direction with respect to said piston such that movement of said crankshaft is configured for adjusting a stroke length of said piston.

114. An engine comprising:

a piston;

a connecting rod attached to said piston; and a rotational crankshaft, said crankshaft comprising an angled segment having an angled segment axis of rotation, said angled segment further comprising a journal portion attached to said connecting rod;

wherein said journal portion extends at an angle with respect to said angled segment axis of rotation;

wherein said crankshaft further comprises multiple segments including a first end portion, wherein said crankshaft further comprises a universal connection intercoupling said angled segment and said first end portion.

115. The engine of claim 114, wherein said crankshaft further comprises a counterweight.

116. The engine of claim 114, wherein said piston is movable through a stroke length along a movement axis, and wherein said angled segment axis of rotation extends at an angle θ with respect to a line that is perpendicular with respect to said movement axis.

117. The engine of claim 114, wherein said engine further comprises a means for moving said crankshaft in a longitudinal direction with respect to said piston such that movement of said crankshaft is configured for adjusting a stroke length of said piston.

118. An engine comprising:

a piston;

a connecting rod attached to said piston;

a rotational crankshaft comprising a journal portion attached to said connecting rod, said crankshaft having a length extending in a longitudinal direction; and means for moving said crankshaft in said longitudinal direction with respect to said piston such that movement of said crankshaft is configured for adjusting a stroke length of said piston;

wherein said crankshaft further comprises multiple segments including an angled segment and a first end portion, wherein said crankshaft further comprises a universal connection intercoupling said angled segment and said first end portion.

119. The engine of claim 118, wherein said journal portion of said crankshaft comprises an axis of rotation, and said journal portion further comprises a portion of said angled segment, and wherein said journal portion extends at an angle with respect to said axis of rotation.

120. The engine of claim 118, wherein said journal portion of said crankshaft comprises a portion of said angled segment, and further comprises an axis of rotation, wherein said piston is movable through a stroke length along a movement axis, and wherein said axis of rotation extends at an angle θ with respect to a line that is perpendicular with respect to said movement axis.

121. The engine of claim 118, wherein a bearing is disposed between said connecting rod and said journal portion.

122. A method of adjusting a stroke length of a piston in an internal combustion engine, said piston having an axis of movement, said method comprising the steps of:

(a) extending a journal portion of a rotational crankshaft at a non-perpendicular angle with respect to said axis of movement of said piston;

(b) moving the crankshaft in a longitudinal direction with respect to said piston; and (c) maintaining a compression ratio of said engine constant as said stroke length is adjusted.

123. The method of claim 122, further comprising attaching a connecting rod to said journal portion and said piston.

124. The method of claim 123, further comprising placing a bearing between said connecting rod and said journal portion.

125. The method of claim 122, further comprising rotating said journal portion about an axis of rotation.

126. The method of claim 125, further comprising forming said journal portion at an angle with respect to said axis of rotation.

127. The method of claim 125, further comprising forming said axis of rotation at an angle that is non perpendicular with respect to said axis of movement.

128. The method of claim 125, further comprising selecting said axis of rotation such that operational characteristics of the engine are optimized.

129. A method of adjusting a stroke length of a piston in an internal combustion engine, said method comprising the steps of:

(a) attaching a connecting rod to said piston and a rotational crankshaft; and (b) moving the crankshaft in three dimensions.

130. The method of claim 129, wherein part (b) further comprises rotating a journal portion of said crankshaft about an axis of rotation.

131. The method of claim 130, further comprising forming said journal portion at an angle $\alpha$ with respect to said axis of rotation.

132. The method of claim 130, further comprising forming said axis of rotation at an angle $\theta$ that is non perpendicular with respect to an axis of movement of said piston.

133. The method of claim 129, wherein part (b) further comprises moving said crankshaft in a longitudinal direction with respect to said piston.

134. An engine comprising:

an engine block having a cylinder;

a piston movable in said cylinder through a stroke length along a movement axis;

a connecting rod pivotally attached to said piston;

a rotational crankshaft extending in a longitudinal direction, said crankshaft comprising a first end portion having a first axis of rotation, a second end portion having a second axis of rotation, and an angled segment having an angled segment axis of rotation, said angled segment being positioned between said first end portion and said second end portion, said angled segment having at least one journal portion for supporting said connecting rod;

means for moving said crankshaft in said longitudinal direction with respect to said piston;

wherein said first axis of rotation and said second axis of rotation are parallel, and wherein said angled segment axis of rotation is non parallel with said first axis of rotation and said second axis of rotation;

wherein said angled segment axis of rotation extends at an angle $\theta$ with respect to a line perpendicular to said movement axis of said piston;

wherein said angle $\theta$ extends in range of between approximately 5 degrees and approximately 25 degrees;

wherein said journal portion of said crankshaft extends at an angle $\alpha$ with respect to said angled segment axis of rotation;

wherein said angle $\alpha$ extends in range of between approximately 5 degrees and approximately 20 degrees;

wherein a bearing is disposed between said connecting rod and said journal portion;

wherein said bearing has a substantially spherical configuration;

wherein said bearing has an opening for receiving said journal portion therethrough;

wherein said engine further comprises an engine head for covering said cylinder;

wherein said engine further comprises a first side support for supporting said first end portion;

wherein said engine further comprises a second side support for supporting said second end portion;

wherein said angled segment comprises an angled segment first end and an angled segment second end;

wherein said angled segment first end comprises a counterweight;

wherein said counterweight comprises a segmented disc shape;

wherein said angled segment second end comprises a collar;

wherein said first end portion is attached to said angled segment through a first universal connection;

wherein said second end portion is attached to said angled segment through a second universal connection; and wherein when said crankshaft is moved in said longitudinal direction, said stroke length of said piston is adjusted.

135. An engine comprising:

a piston movable through a stroke length along a movement axis;

a connecting rod attached to said piston;

a rotational crankshaft having a journal portion attached to said connecting rod, said crankshaft extending in a longitudinal direction;

means for moving the piston in a reciprocating movement to thereby cause the connecting rod to rotate the crankshaft about an axis of rotation;

wherein said journal portion of said crankshaft is disposed at a non-zero angle with respect to a line that is perpendicular with the movement axis of the piston;

wherein a top dead center position of the piston is identical for multiple stroke length positions of said piston when said stroke length is adjusted by movement of said crankshaft in said longitudinal direction.

* * * * *